US005471292A

United States Patent [19]

Okazawa

[11] Patent Number: 5,471,292

[45] Date of Patent: Nov. 28, 1995

[54] IMAGE FORMING APPARATUS CAPABLE OF ADJUSTING DRIVE CONTROL OF DEVELOPER UNIT

[75] Inventor: Kazuhiko Okazawa, Yokohama, Japan

[73] Assignee: Canon Kabushiki Kaisha, Tokyo, Japan

[21] Appl. No.: 259,686

[22] Filed: Jun. 13, 1994

[30] Foreign Application Priority Data

| | | | |
|---|---|---|---|
| Jun. 15, 1993 | [JP] | Japan | 5-168586 |
| Jun. 15, 1993 | [JP] | Japan | 5-168587 |
| Sep. 14, 1993 | [JP] | Japan | 5-250972 |

[51] Int. Cl.[6] ..... G03G 15/01; G03G 15/06

[52] U.S. Cl. ..... 355/326 R; 355/208; 355/245

[58] Field of Search ..... 355/204, 205, 355/207, 208, 245, 326 R, 327

[56] References Cited

U.S. PATENT DOCUMENTS

| | | | |
|---|---|---|---|
| 4,713,673 | 12/1987 | Kessoku | 355/245 |
| 4,782,360 | 11/1988 | Iwamoto et al. | 355/326 R |
| 4,939,548 | 7/1990 | Yamada et al. | 355/245 |
| 5,132,733 | 7/1992 | Koizumi et al. | 355/245 |
| 5,160,969 | 11/1992 | Mizuma et al. | 355/326 R |
| 5,294,967 | 3/1994 | Munakata et al. | 355/326 R |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

An image forming apparatus includes an image carrier for carrying an electrostatic image, a developer unit having a plurality of developers each for developing the electrostatic image on the image carrier, a drive circuit for driving the developer unit to stop a selected developer at a predetermined position facing the image carrier, a detection circuit for detecting the stop position of the developer, and an adjustment circuit for adjusting drive control of the developer unit by the drive circuit in accordance with a detection output from the detection circuit.

16 Claims, 19 Drawing Sheets

IMAGE FORMING APPARATUS CAPABLE OF ADJUSTING DRIVE CONTROL OF DEVELOPER UNIT

BACKGROUND OF THE INVENTION

1. Field of the Invention

The present invention relates to an image forming apparatus such as a copying machine, a printer, or the like and, more particularly, to an image forming apparatus including a plurality of developers.

2. Related Background Art

FIG. 11 is a schematic view showing an example of the drive arrangement of a developer selection unit 1 in an image forming apparatus including a plurality of developers.

Note that a photosensitive drum 9 on which an optical image 10 is exposed, and a transfer drum 11 for carrying a recording medium are arranged near the unit 1. The developer selection unit 1 comprises sensor flags 2*a*, 2*b*, 2*c*, and 2*d* fixed on its rotary surface in correspondence with the developers. A drive gear 5 for transmitting the drive force of a stepping motor 6 is engaged with the rotary surface of the developer selection unit 1.

With this arrangement, a position switching operation of the developer selection unit 1 is performed via the drive gear 5 by driving the stepping motor 6.

A flag sensor 3 for detecting one of the sensor flags 2*a*, 2*b*, 2*c*, and 2*d*, and a developer/toner sensor 12 for detecting the presence/absence of a developer and the presence/absence of a toner in the developer are arranged as shown. These sensors are connected to a central processing unit (CPU) in a motor control circuit 7. The CPU is connected to a memory 7*a* and a motor driver 7*b*, which is further connected to the stepping motor 6.

The selection/positioning operation of a developer is performed by detecting one of the sensor flags 2*a*, 2*b*, 2*c*, and 2*d* corresponding to developers a, b, c, and d by the flag sensor 3, and by counting the number of driven steps of the stepping motor 6 by the motor control circuit 7.

The selection/positioning operation of a developer will be described below with reference to the timing chart in FIG. 12.

When the developer selection unit 1 is driven, the flag sensor 3 detects the sensor flag 2*a* of a certain developer (e.g., a) to recognize the position of the developer a. Then, the developer selection unit 1 is driven in a predetermined developing profile (P0-P1-P2-P3), and is stopped at a position where the developer a faces the photosensitive drum 9, thus performing a developing operation. More specifically, when the position of the developer a is recognized (61), the motor control circuit 7 starts the counting operation of the number of driven steps of the stepping motor 6, and accelerates the stepping motor 6 until the count value reaches a predetermined number of steps (62). Then, a predetermined rotational speed, i.e., a drive frequency is maintained until the count value reaches another predetermined number of steps, and thereafter, a predetermined deceleration operation, i.e., a slowdown operation is performed (63) to stop the stepping motor (64).

Each developer has a developing sleeve, a toner, and the like, and is normally as heavy as several hundreds grams to 1 kg or more. Therefore, in order to rotate the developer selection unit which holds the plurality of developers, it is required to control a large inertial load especially upon starting and stopping of the rotation. For this purpose, the time required for each of a startup acceleration operation and a deceleration operation must be long. However, when the developer selection time is long, the throughput of the apparatus is lowered, and an increase in selection time is limited. Therefore, it is required to perform startup and deceleration operations as quick as possible.

In control of a stepping motor, since the motor is normally designed to have a torque margin, a deviation of the stop position of a developer to be controlled need not be taken into consideration. However, in the case of the developer selection unit, since the weight of each developer varies depending on consumption of a toner in the developer, the wear of a sliding portion, and the like, a variation in load balance is very large. For example, as shown in FIG. 13, when the two adjacent developers a and d of the four developers a, b, c, and d are full of respective toners, and the remaining developers b and c are empty, the load on the motor becomes largest.

When developers are detachable from the developer selection unit, four developers for four colors are attached to the developer selection unit in a normal full-color print mode. However, in a monochrome, two-color, or three-color print mode, the four developers are not always attached. For example, as shown in FIG. 14, only two developers 8*a* and 8*b* may be attached at adjacent positions. The developer selection unit in this state imposes, to the stepping motor, a load requirement larger by several times than that imposed when the four developers are attached. Since the developers are locally offset, a variation in the load upon rotation is also large.

To say nothing of a normal full-color print mode, when a monochrome print operation or a color print operation of three colors or less is performed for a large number of sheets, since the weights of color toners change during the print process, the weight balance of the developer selection unit with respect to rotation changes. For example, when two adjacent developers of four developers are heavy, and the remaining two developers are light, the load becomes larger than that obtained when all the four developers have uniform weights.

Therefore, even when a single drive profile shown in FIG. 12 is set for the stepping motor, the deceleration operation may become insufficient depending on a change in condition of the developers, and the like. In this case, the stepping motor causes an out-of-phase state, and the developer selection unit 1 does not stop at a required position, e.g., overruns a target stop position by CTaov, as shown in FIG. 13.

When the drive profile of the stepping motor is set to perform a deceleration operation with a margin within a limited time, if the inertia of the developer selection unit 1 is small, considerable vibration and noise are generated in a low-speed range.

SUMMARY OF THE INVENTION

It is an object of the present invention to provide an image forming apparatus which can stably drive a developer unit independently of a variation in load of the developer unit.

It is another object of the present invention to provide an image forming apparatus which can obtain high stop position precision independently of a variation in load of a developer unit.

It is still another object of the present invention to provide an image forming apparatus comprising an image carrier for carrying an electrostatic image, a developer unit having a plurality of developers for developing the electrostatic image on the image carrier, drive means for driving the developer unit to stop a selected developer at a developing position facing the image carrier, and adjustment means for adjusting drive control of the developer unit by the drive means.

Other objects of the present invention will become apparent from the following description.

DESCRIPTION OF THE PREFERRED EMBODIMENTS

First Embodiment

Figure 10:
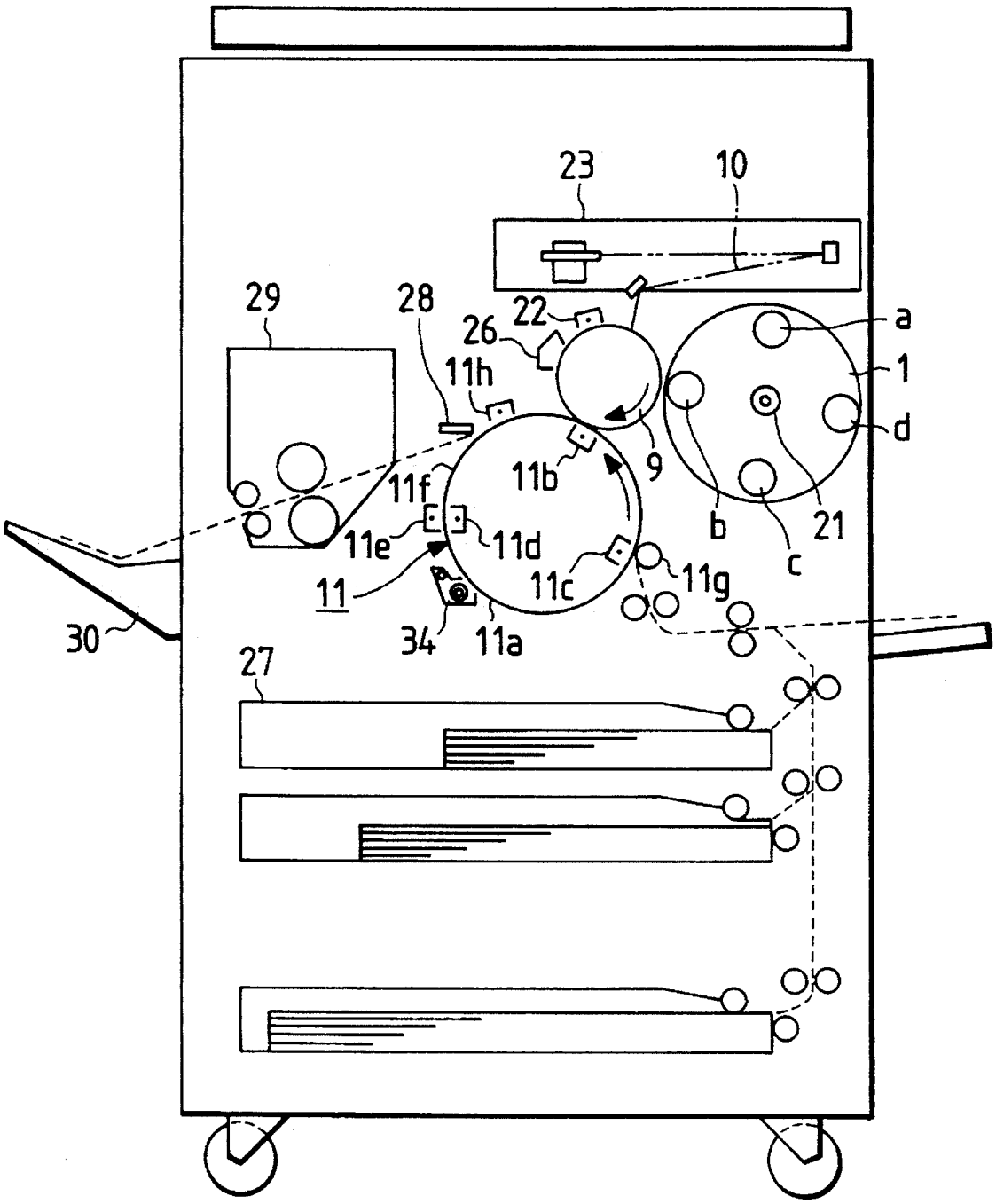
FIG. 10 is a schematic sectional view showing an example of the arrangement of an electrophotographic multi-color image forming apparatus.
Figure 11:
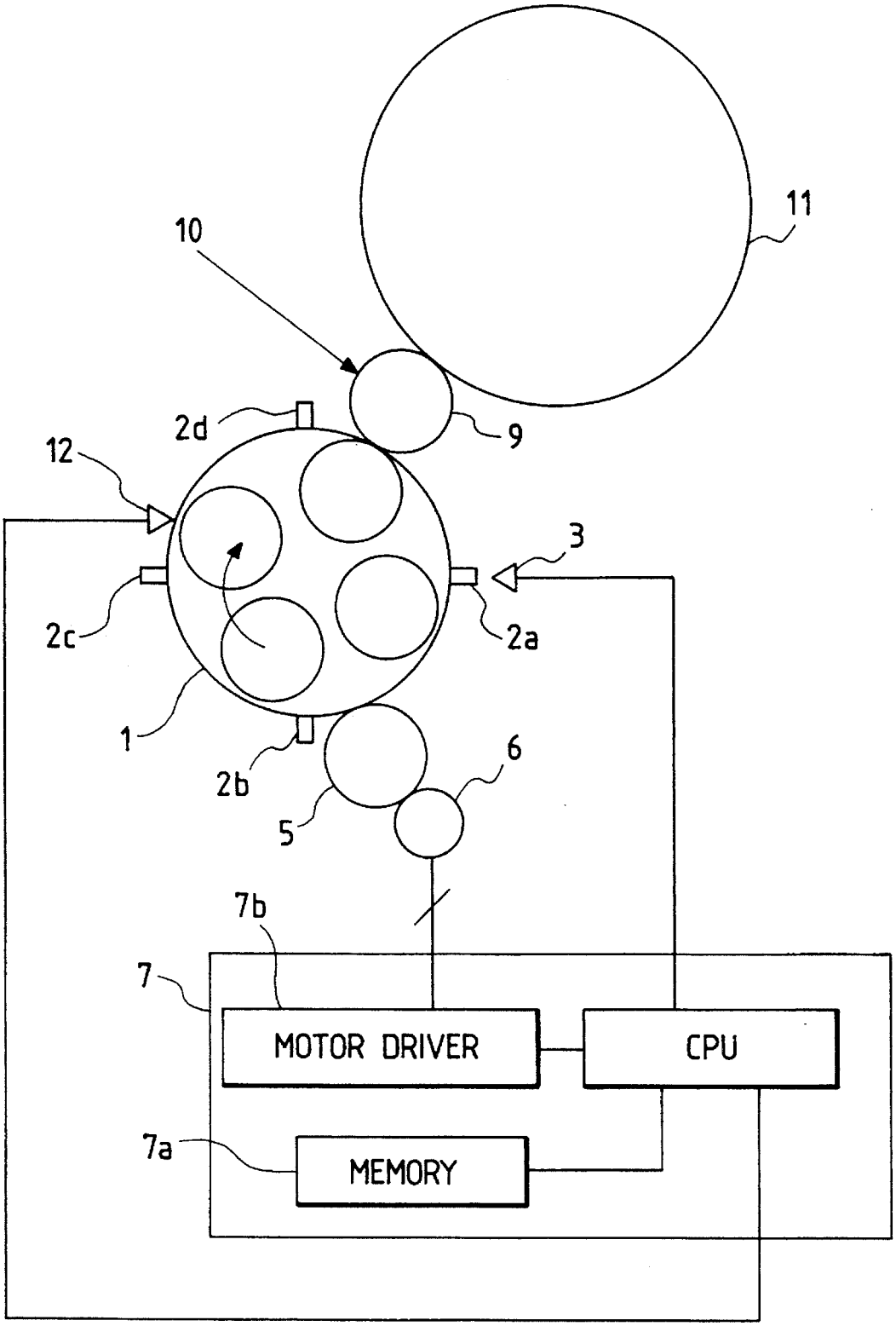
FIG. 11 is a schematic view showing a drive system of a developer selection unit in the multi-color image forming apparatus shown in FIG. 10.
Figure 12:
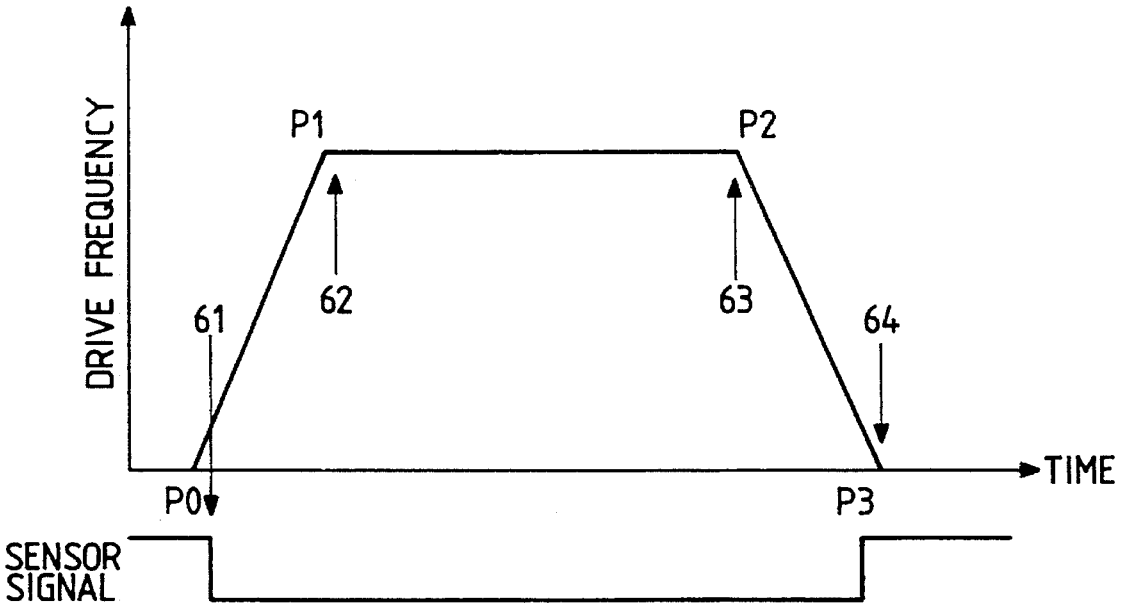
FIG. 12 is a timing chart showing a motor drive profile applied to the conventional multi-color image forming apparatus.
Figure 13:
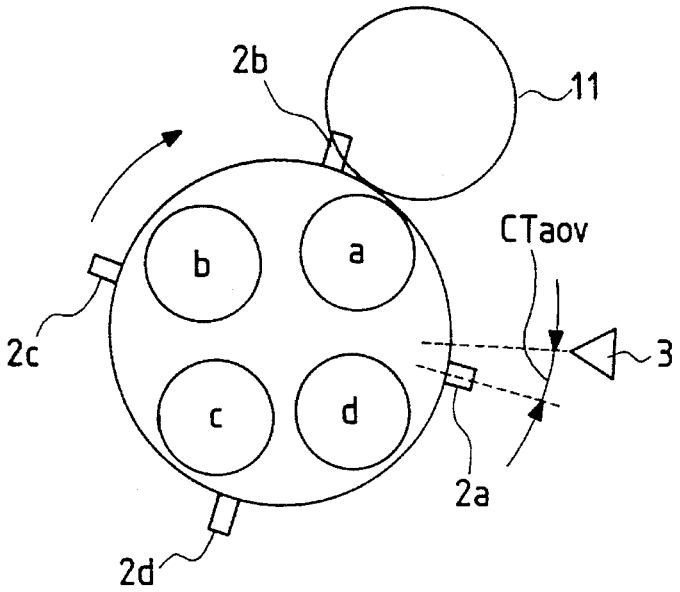
FIG. 13 is a schematic view showing a control process of the developer selection unit.
Figure 14:
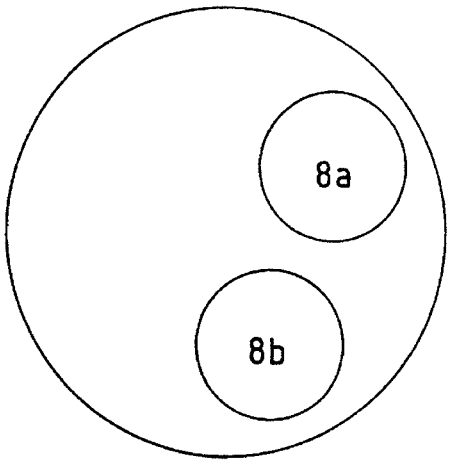
FIG. 14 is a view showing an example of a developer attachment pattern.

FIG. 10 is a sectional view of an image forming apparatus according to an embodiment of the present invention.

Referring to FIG. 10, in a multi-color image forming apparatus, a photosensitive drum 9 (image carrier) is supported to be rotatable in the direction of an arrow in FIG. 10, and a corona charger 22, an optical system 23, a developer selection unit 1, a transfer device 11, and a cleaning device 26 are arranged around the photosensitive drum 9.

The optical system 23 comprises a laser beam exposure device which is constituted by an original scanning unit and color-separation filters, as shown in FIG. 10, and radiates color-separated optical images or a corresponding optical image 10 onto the photosensitive drum 9.

The optical image 10 is radiated onto the photosensitive drum 9, which is uniformly charged by the corona charger 22, in units of separated colors thereby forming a latent image. In the developer selection unit 1, four developers a, b, c, and d which store different color toners are arranged around a central shaft 21, and a predetermined developer is rotated to a developing position facing the photosensitive drum 9 to develop the latent image on the photosensitive drum 9, thereby forming a toner image on the photosensitive drum 9.

The toner image on the photosensitive drum 9 is transferred onto a recording medium which is supplied from one of several recording medium cassettes 27 to a position facing the photosensitive drum 9 along a path indicated by a dotted line in FIG. 10 via a convey system and the transfer device 11. The transfer device 11 comprises a transfer drum 11*a*, a transfer corona charger 11*b*, an attraction roller 11*g* facing an attraction corona charger 11*c* for electrostatically attracting a recording medium, an inner corona charger 11*d*, and an outer corona charger 11*e*. A recording medium carrier sheet 11*f* consisting of a dielectric member is integrally extended on an opening region of the circumferential surface of the transfer drum 11*a*, on which it is rotatably and axially supported.

Upon rotation of the transfer drum 11*a*, toner images on the photosensitive drum 9 are sequentially transferred by the transfer charger 11*b* onto the recording medium carried on the recording medium carrier sheet 11*f*, thus forming a multi-color image.

Upon completion of the transfer operation of a required number of toner images, the recording medium is separated from the transfer drum 11*a* by a separation means 28, and is discharged onto a tray 30 via a thermal roller fixing device 29.

On the other hand, after the transfer operations, residual toners on the surfaces of the photosensitive drum 9 and the recording medium carrier sheet 11*f* are cleaned by the cleaning device 26 and a transfer cleaner 34 as their corresponding cleaning means, thus preparing for the next image forming process.

Drive control of a developer unit will be described in detail below with reference to FIGS. 1 to 7 and FIG. 10.

Figure 1:
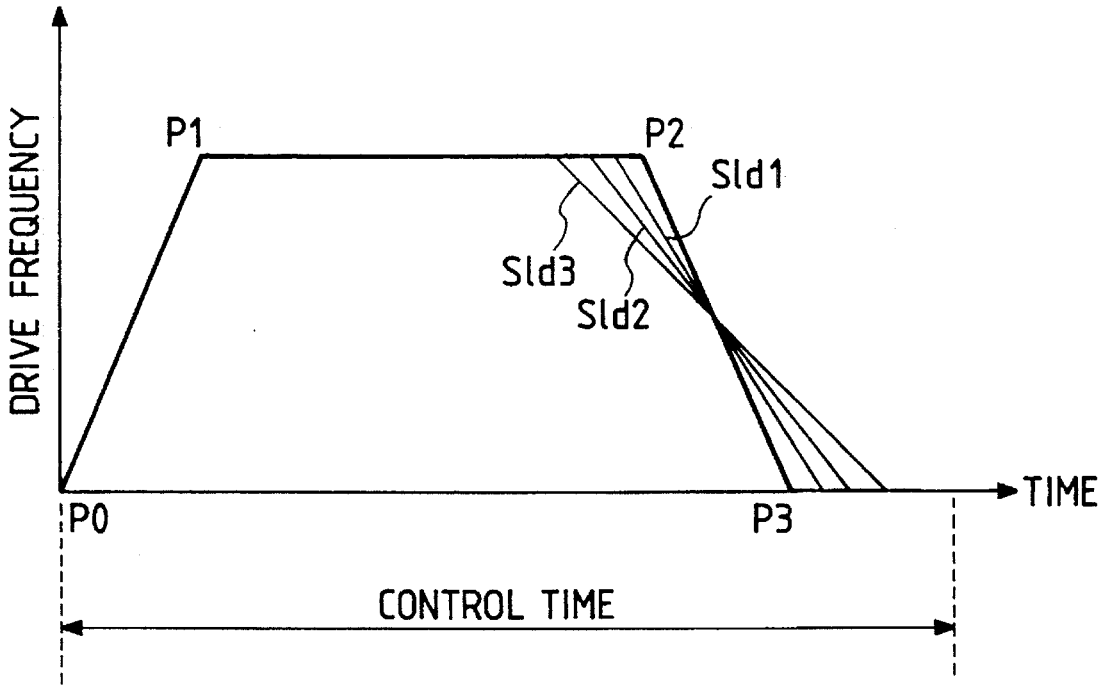
FIG. 1 is a timing chart showing motor drive profiles to be applied to the first embodiment of a multi-color image forming apparatus according to the present invention.
Figure 5:
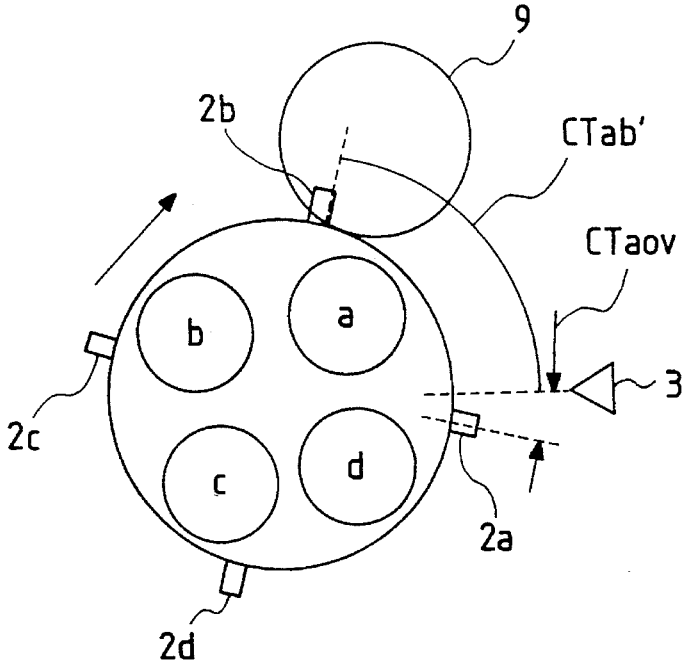
FIG. 5 is a fourth schematic view following FIG. 2 and showing a state wherein the developer selection unit overruns the target position.
Figure 6:
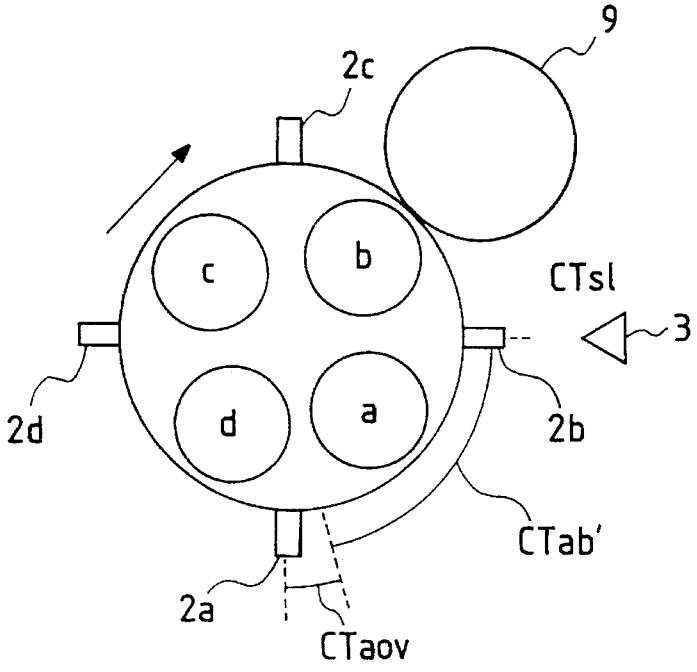
FIG. 6 is a fifth schematic view following FIG. 5 and showing a state wherein the deviation from the target position is calculated.
Figure 7:
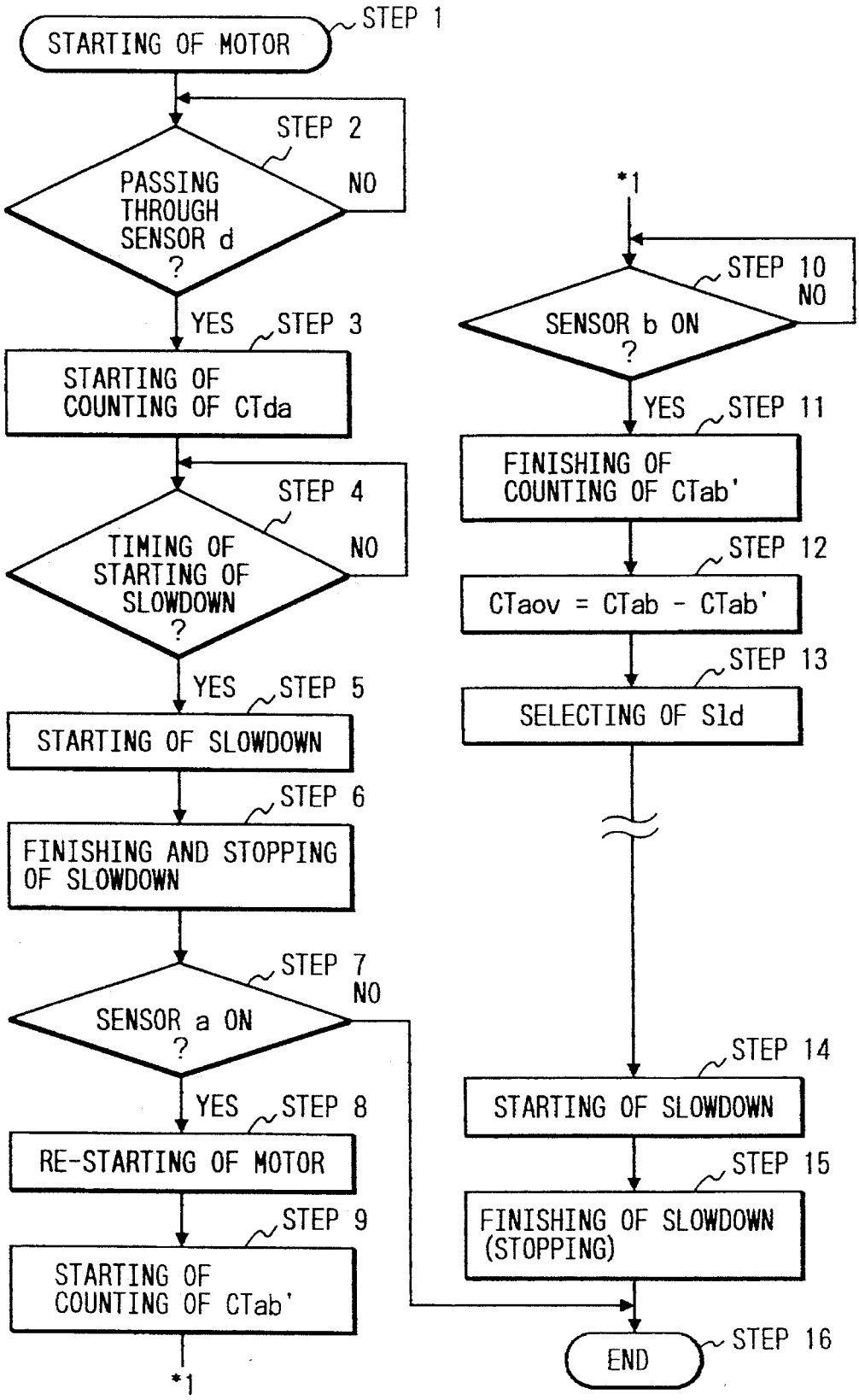
FIG. 7 is a flow chart showing the control process of the developer selection unit in the first embodiment.

Note that FIG. 1 is a timing chart showing the drive profiles of a stepping motor, FIGS. 2 to 6 are schematic views showing the rotation control state of the developer selection unit, and FIG. 7 is a flow chart showing the control process of the developer selection unit.

Actual control will be described below with reference to a case wherein the developer a is moved to the position facing the photosensitive drum 9. Note that the positional relationship in which one of sensor flags 2*a*, 2*b*, 2*c*, and 2*d* can be detected by a sensor 3 is assumed to be established when the developer selection unit 1 is located at the developing position.

Figure 2:
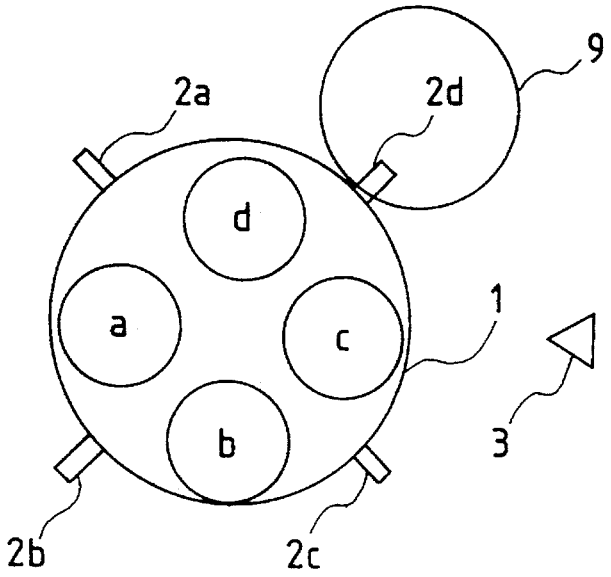
FIG. 2 is a first schematic view showing a control process of a developer selection unit in the first embodiment.
Figure 3:
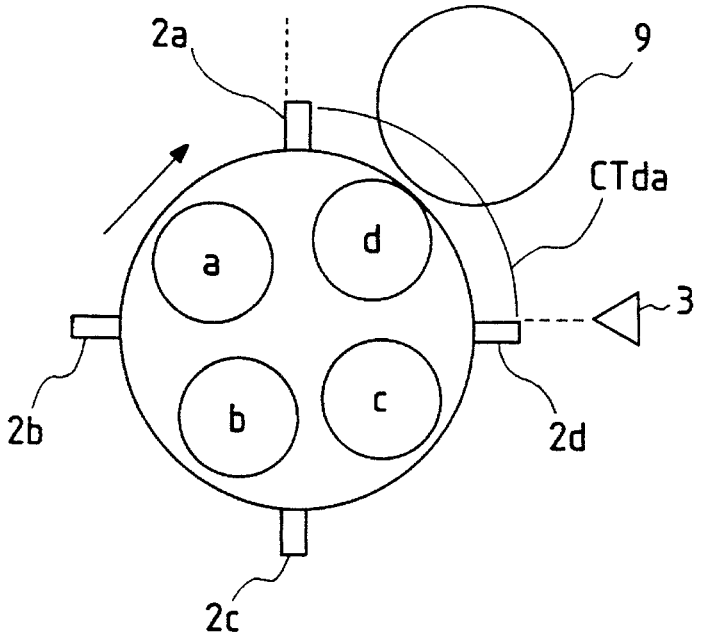
FIG. 3 is a second schematic view following FIG. 2.

The stepping motor (to be simply referred to as a motor hereinafter) is powered and started (FIG. 2, step 1 in FIG. 7). At this time, since the state of the load is unknown, when the sensor flag 2*d* of the developer d arranged at a position immediately before the developer a in the rotational direction passes the sensor 3 (step 2), the counting operation of the number CTda of driven steps of the motor is started (FIG. 3, step 3).

Figure 4:
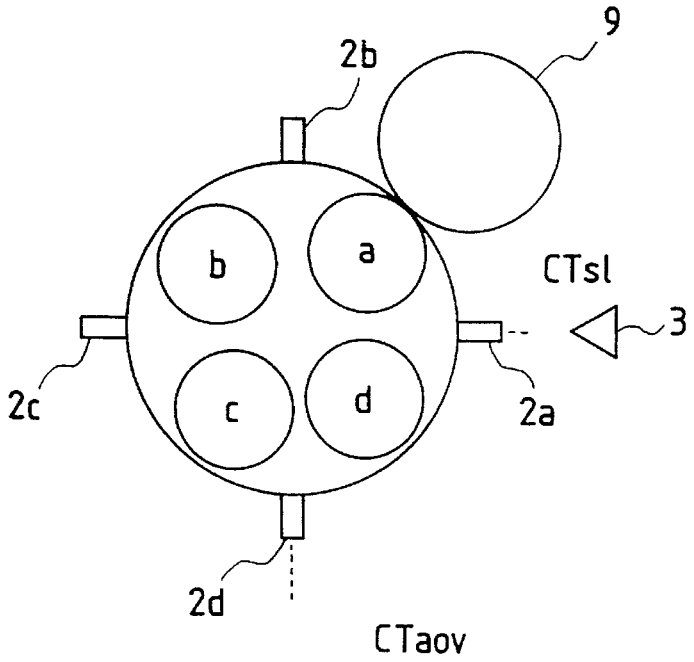
FIG. 4 is a third schematic view following FIG. 3 and showing a state wherein the developer selection unit is stopped at a target position.

The developer selection unit 1 is then driven in accordance with the drive profile (P0-P1-P2-P3) shown in FIG. 1. More specifically, after the motor is accelerated from when it is started (P0) until a predetermined drive frequency is reached (P1), the number of driven steps is counted while a predetermined rotational speed, i.e., the drive frequency is maintained. When the number of driven steps has reached a predetermined value (P2; step 4), a deceleration operation, i.e., a slowdown operation is started (step 5). Upon completion of the slowdown operation, the motor stops at P3 (step 6). When a normal operation is performed, the developer a is located at the position facing the photosensitive drum 9, and the sensor flag 2*a* of the developer a is located at the position facing the sensor 3, as shown in FIG. 4.

However, when the load is too large or the developer selection unit 1 has poor balance, the developer a overruns, and the stop position of the developer a is offset from the photosensitive drum 9, i.e., the stop position of the sensor flag 2*a* is offset from the sensor 3 by CTaov, as shown in FIG. 5.

In this state, whether or not the sensor flag 2*a* overruns the position facing the sensor 3 is detected (step 7). If it is detected that the flag 2*a* has not overrun the facing position, the next process, i.e., the developing process is started.

On the other hand, if it is detected that the sensor flag 2*a* has overrun the position facing the sensor 3, the motor is re-started (step 8), thus executing the following process. More specifically, the counting operation of the number CTab' of driven steps up to the developer b next to the developer a is started (step 9), and when it is confirmed that the sensor flag 2*b* has reached a position facing the sensor 3 (step 10), as shown in FIG. 6, the counting operation ends (step 11). Then, the difference between the count value CTab' and a theoretical number CTab of driven steps is calculated, and is determined to be an overrun moving amount CTaov (step 12).

As the overrun amount CTaov becomes larger, the inertial load is larger, and the time required for the slowdown operation must be prolonged. Thus, one of slowdown curves S1d1 to S1d3 shown in FIG. 1 is selected in correspondence with the overrun amount CTaov, as shown in Table 1 below (step 13), and is stored in a memory. When the developer a is selected next time, the slowdown operation is started (step 14) and finished (step 15) in accordance with the selected slowdown curve. The total number of driven steps remains the same independently of any curve selected, and the drive time changes within a limit time.

As described above, the drive control of the developer unit can be adjusted in accordance with the overrun amount CTaov.

TABLE 1

| CTaov | 0 | 1 to 5 | 6 to 10 | >10 |
|---|---|---|---|---|
| Slowdown Curve to be Selected | Default | Sld1 | Sld2 | Sld3 |

Note that the overrun amounts CTaov and slowdown curves S1d are merely examples, and the present invention is not limited to these values and patterns. A proper table can be formed in accordance with the load system involved.

Upon detection of exchange of the developers and toner re-fill operation by a developer/toner sensor 12, the drive profile is returned to a default drive profile, and a proper drive profile is selected again.

Second Embodiment

Figure 8:
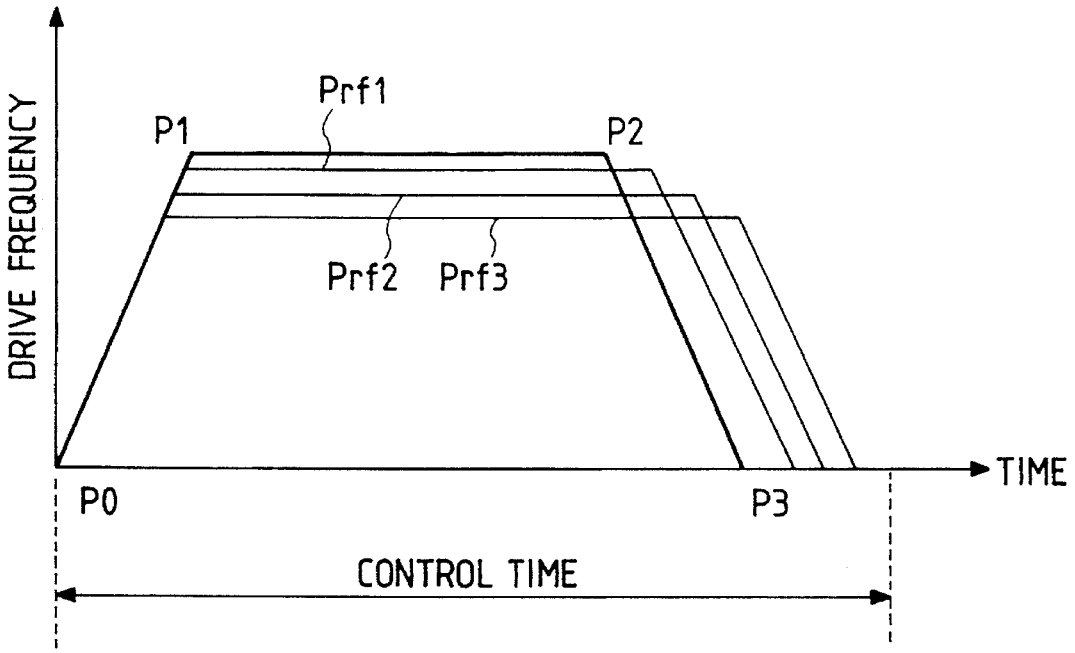
FIG. 8 is a timing chart showing motor drive profiles to be applied to the second embodiment of a multi-color image forming apparatus according to the present invention.

The second embodiment of a multi-color image forming apparatus according to the present invention will be described below with reference to the timing chart showing the drive profiles of a stepping motor in FIG. 8. Since this embodiment has the same arrangement and the same process until the overrun amount CTaov is calculated as those in the first embodiment, a detailed description thereof will be omitted.

This embodiment pays attention to the fact that the inertial load is larger as the overrun amount CTaov becomes larger, and changes the maximum drive speed, i.e., the maximum drive frequency to one of Prf1, Prf2, and Prf3 in accordance with Table 2 below, so as to decrease the inertia itself. More specifically, the drive profiles shown in FIG. 8 are set to decrease the maximum drive speed as the overrun amount CTaov is larger. As in the first embodiment, the total number of driven steps remains the same independently of any drive profile selected, and the drive time changes within a limit time.

TABLE 2

| CTaov | 0 | 1 to 5 | 6 to 10 | >10 |
|---|---|---|---|---|
| Drive Profile to be Selected | Default | Prf1 | Prf2 | Prf3 |

Note that the overrun amounts CTaov and slowdown curves S1d are merely examples, and the present invention is not limited to these values and patterns. A proper table can be formed in accordance with the load system of interest.

Upon detection of exchange of the developers and toner re-fill operation by the developer/toner sensor 12, the drive profile is returned to a default drive profile, and a proper drive profile is selected again.

Third Embodiment

Figure 9:
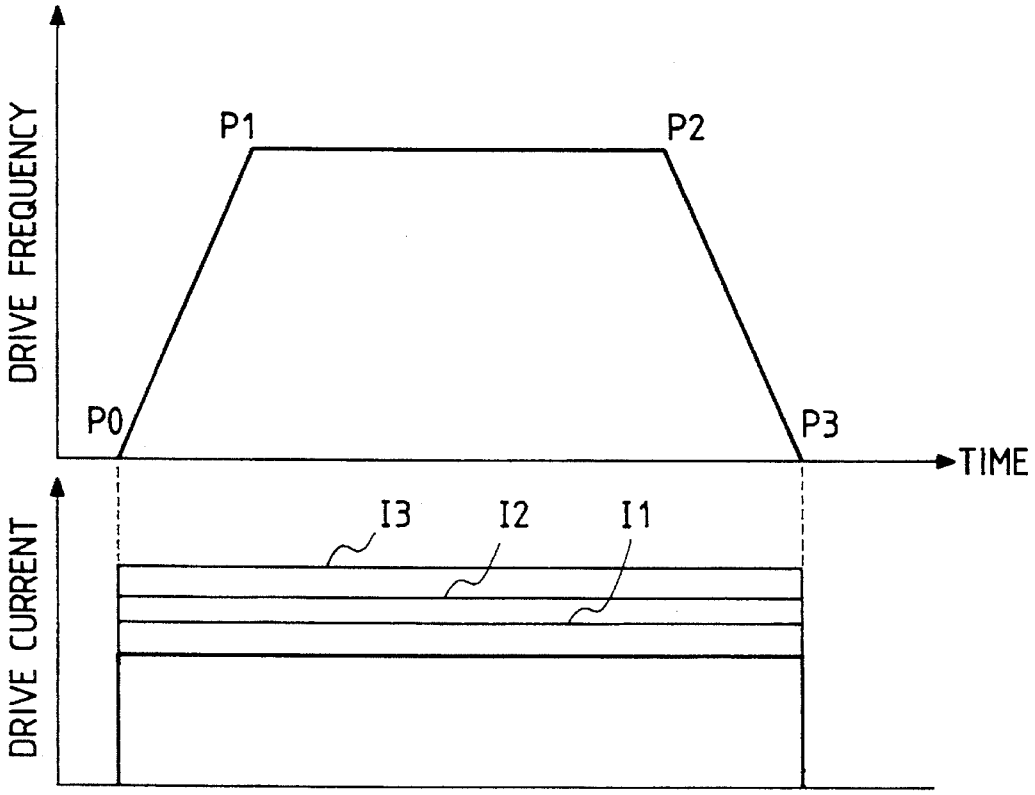
FIG. 9 is a timing chart showing motor drive profiles to be applied to the third embodiment of a multi-color image forming apparatus according to the present invention.

The third embodiment of a multi-color image forming apparatus according to the present invention will be described below with reference to the timing chart showing the drive profiles of a stepping motor in FIG. 9. Since this embodiment has the same arrangement and the same process until the overrun amount CTaov is calculated as those in the first embodiment, a detailed description thereof will be omitted.

This embodiment pays attention to the fact that the output torque of a motor increases as the current to be supplied to the motor increases, and sets a larger drive current of the developer selection unit as the load is larger, i.e., the overrun amount CTaov is larger. In this embodiment, as shown in Table 3 below, as the overrun amount CTaov increases, one of several drive currents which become larger in the order of I1, I2, and I3 is selected, and the motor is driven by the previously selected drive current upon selection of the developer 2*a* next time.

TABLE 3

| CTaov | 0 | 1 to 5 | 6 to 10 | >10 |
|---|---|---|---|---|
| Drive Current to be Selected | Default | I1 | I2 | I3 |

Upon detection of exchange of the developers and toner re-fill operation by the developer/toner sensor 12, the drive current is returned to a default drive current.

Note that the overrun amounts CTaov and the drive currents I1, I2, and I3 in Table 3 are merely examples, and the present invention is not limited to these values. Thus, a proper table can be formed in correspondence with each load system.

Also, selection of the drive current according to this embodiment, and selection of the drive profile according to the first or second embodiment may be combined.

Fourth Embodiment

An embodiment wherein developers are detachable from a developer unit will be described below.

The fourth embodiment of an image forming apparatus according to the present invention will be described below with reference to the timing chart showing the motor drive profiles in FIG. 15, and the pattern views of the developer attachment states in FIGS. 16 to 20.

Figure 15:
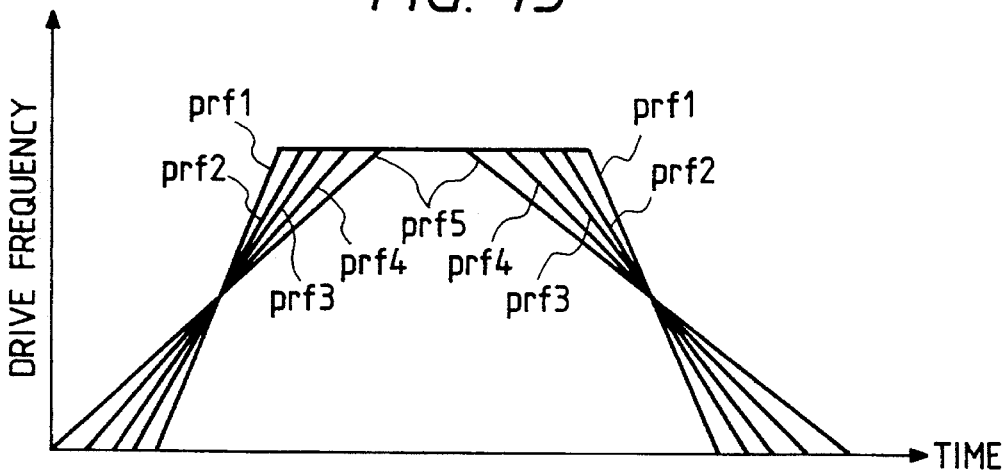
FIG. 15 is a timing chart showing the drive profiles of a stepping motor according to the fourth embodiment of an image forming apparatus of the present invention.

When a developer selection unit 1 is started, since a motor control circuit 7 does not recognize the attachment state of developers to the developer selection unit, a stepping motor 6 is started according to a drive profile prf5 to be applied to a maximum load of those shown in FIG. 15. Note that the drive profiles shown in FIG. 15 are set to allow application to larger loads in the order of the profiles prf1 to prf5. More specifically, the slowup and slowdown gradients become smaller in the order of prf1 to prf5, and the drive profile prf5 has slowup and slowdown curves of the smallest gradients, as shown in FIG. 15.

When the developer selection unit 1 is rotated on the basis of the drive profile prf5, sensor flags corresponding to the attached developers pass the position of a sensor 3, and the number and positional relationship of attached developers of the developer selection unit 1 are recognized by the motor control circuit 7 in accordance with the number of driven steps of the stepping motor 6 and the lengths of the sensor flags.

The number and positional relationship of the attached developers correspond to one of the pattern views shown in FIGS. 16 to 20. More specifically, when the developer selection unit 1 is started and completes one revolution, the motor control circuit 7 recognizes that number and positional relationship of the attached developers correspond to one of the pattern views shown in FIGS. 16 to 20.

Figure 16:
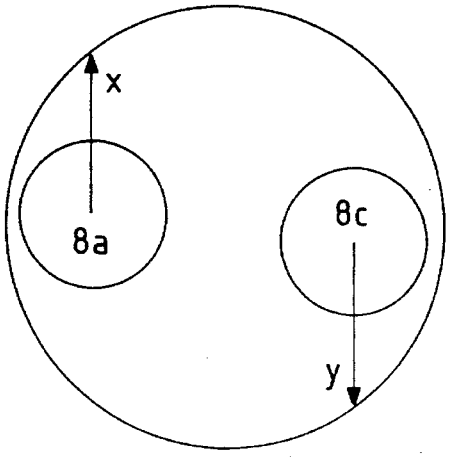
FIG. 16 is a pattern view showing the first example of a developer attachment pattern of the developer selection unit.
Figure 17:
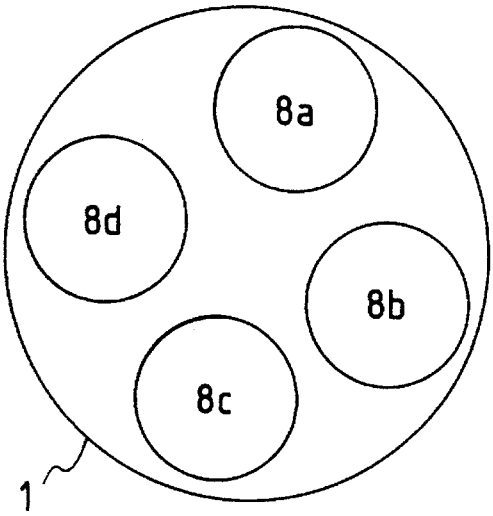
FIG. 17 is a pattern view showing the second example of the developer attachment pattern.
Figure 18:
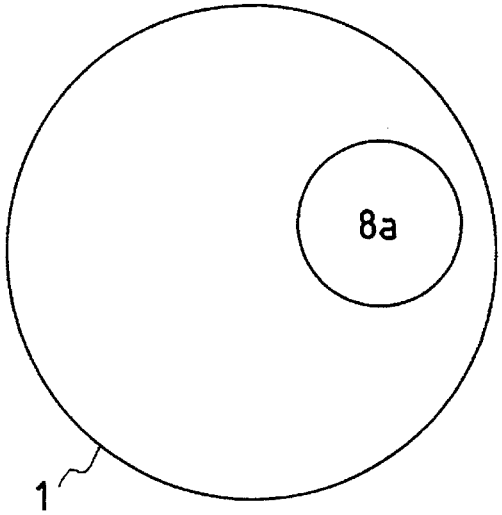
FIG. 18 is a pattern view showing the third example of the developer attachment pattern.
Figure 19:
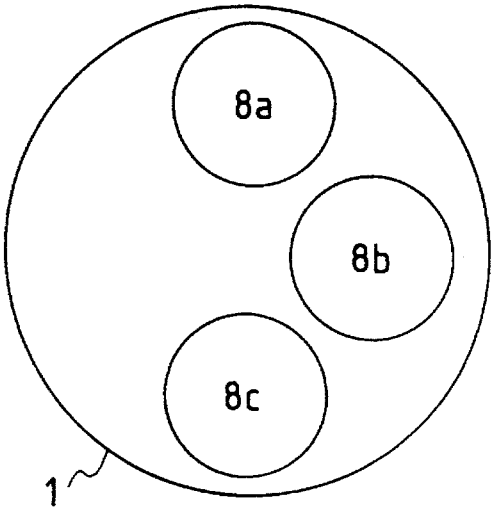
FIG. 19 is a pattern view showing the fourth example of the developer attachment pattern.
Figure 20:
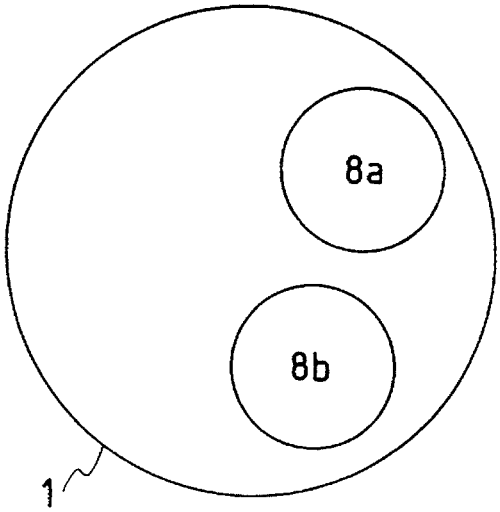
FIG. 20 is a pattern view showing the fifth example of the developer attachment pattern.

Of the five attachment states shown in FIGS. 16 to 20, in the state wherein two developers 8*a* and 8*c* are attached at symmetrical positions, as shown in FIG. 16, and in the state wherein all four developers are attached, as shown in FIG. 17, a force x for moving the developers upward and a force y according to the gravity are always balanced upon rotation of the developer selection unit 1, as shown in FIG. 16. For this reason, the developer selection unit 1 is in a predetermined load state regardless of the positions of the developers. Also, the loads in these states can be driven by a lower torque than those required for driving the loads in the state wherein one developer is attached, as shown in FIG. 18, in the state wherein three developers are attached, as shown in FIG. 19, and in the state wherein two developers are attached at offset positions, as shown in FIG. 20. Upon comparison between the developer attachment states shown in FIGS. 16 and 17, the load in the developer attachment state shown in FIG. 16, which includes a smaller number of developers and has a smaller weight of the overall load can be driven by a lower torque than that required for the load in the state shown in FIG. 17.

Upon comparison of drive torques required for driving the load in the developer attachment states 1 shown in FIGS. 18 to 20, the loads are similarly locally offset in these three states. Of these states, it is apparent that the attachment state shown in FIG. 20 requires the highest torque. Upon comparison between the attachment states shown in FIGS. 18 and 19, although these states have the same balance state, the attachment state in FIG. 19 requires a higher drive torque since it has a larger load weight than that in the state in FIG. 18. Therefore, the attachment states shown in FIGS. 16 to 20 require higher torques in the order of the number of figures.

Therefore, when the drive profiles prf1 to prf5 shown in FIG. 15 are applied to the drive control of the stepping motor 6 in accordance with the developer attachment states shown in FIGS. 16 to 20, as shown in Table 4 below, the start, rotation, and stop operations of the developer selection unit 1 can be precisely and smoothly performed in any attachment state.

TABLE 4

| Developer Attachment State | FIG. 16 | FIG. 17 | FIG. 18 | FIG. 19 | FIG. 20 |
|---|---|---|---|---|---|
| Profile to be Selected | prf 1 | prf 2 | prf 3 | prf 4 | prf 5 |

When the two developers 8*a* and 8*c* are symmetrically attached, as shown in FIG. 16, since the total weight of the developer selection unit is small, high-speed rotation can be performed. However, in this case, since the distance between the developers 8*a* and 8*c* is twice as large as that between two adjacent developers in the attachment state shown in FIG. 17, the switching time of the developers is prolonged. Therefore, since the rotational speed of the developer selection unit 1 cannot be doubled in a system wherein a transfer drum 11 is rotated at a constant speed, the drive profile cannot often be set so that the switching operation of the developers is finished in time for the original transfer timing. In this case, the developer switching time for the second color is prolonged, as indicated by f2 in the timing chart in FIG. 21, and the transfer operation of the second color is performed at a third transfer timing 73 in place of an original transfer timing 72. Alternatively, as shown in the timing chart in FIG. 22, the transfer operation of the second color may be performed at a fourth transfer timing 74. Thus, a proper drive profile can be selected.

In the state wherein two developers 8*a* and 8*b* are attached at offset positions on one side of the unit 1, as shown in FIG. 20, the same means as described above can be used in the switching operation from the developer 8*b* to the developer 8*a*.

Fifth Embodiment

The fifth embodiment of an image forming apparatus according to the present invention will be described below mainly with reference to FIGS. 23 to 30.

Figure 23:
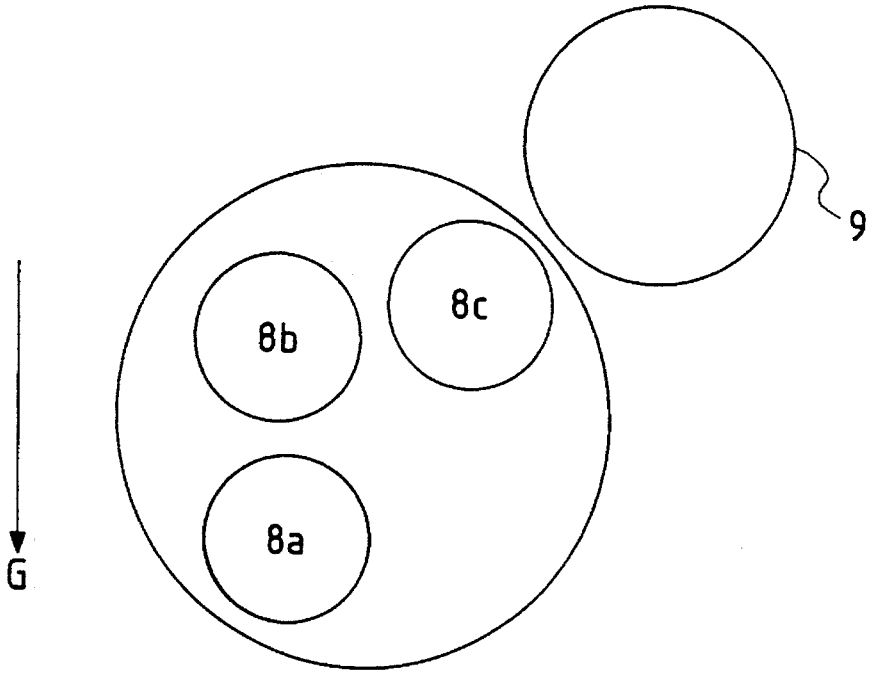
FIG. 23 is a first state view of developers for explaining the fifth embodiment of an image forming apparatus according to the present invention.
Figure 24:
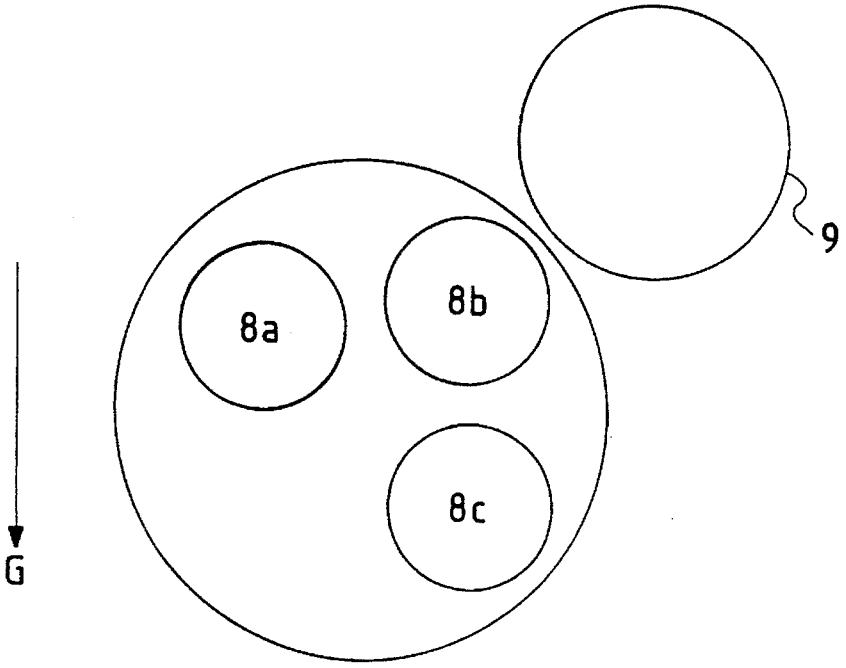
FIG. 24 is a second state view of developers for explaining the fifth embodiment.
Figure 25:
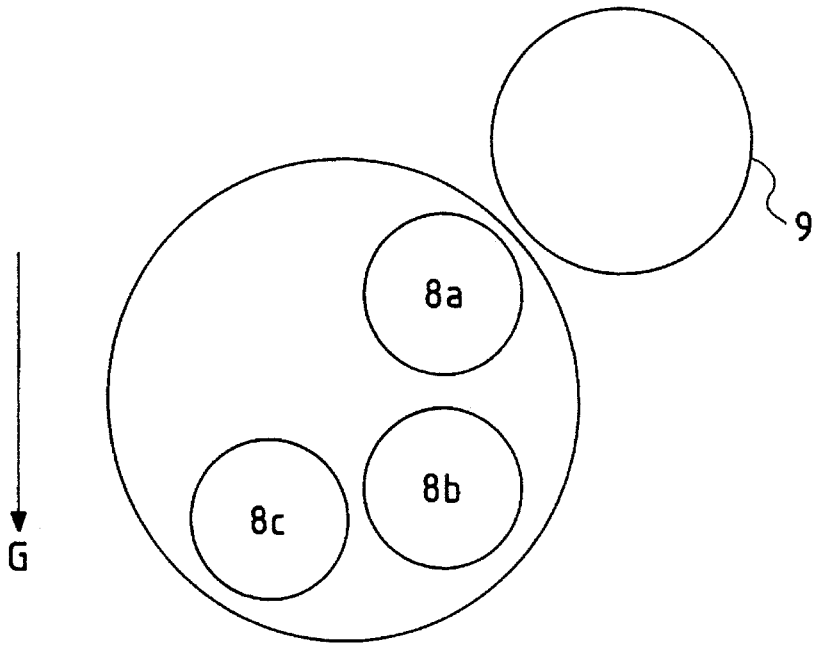
FIG. 25 is a third state view of developers for explaining the fifth embodiment.

In the above developer attachment state shown in FIG. 19, when the developers are switched, as shown in FIGS. 23 to 25, while the developer selection unit rotates clockwise in FIG. 19, the load imposed on the motor changes depending on the positions of the 10 developers on the developer selection unit.

For example, when the state shown in FIG. 23 is switched to the state shown in FIG. 24, i.e., when a developer 8*c* is switched to a developer 8*b*, the central developer 8*b* as the center of the balance among the three developers 8*a*, 8*b*, and 8*c* moves in a direction against gravity G when the rotation is started, and moves in the same direction as gravity G when rotation is stopped. When rotation is stopped, the motor must be braked in the direction against the direction of gravity G. For this reason, slowup and slowdown operations require a relatively high torque.

Figure 26:
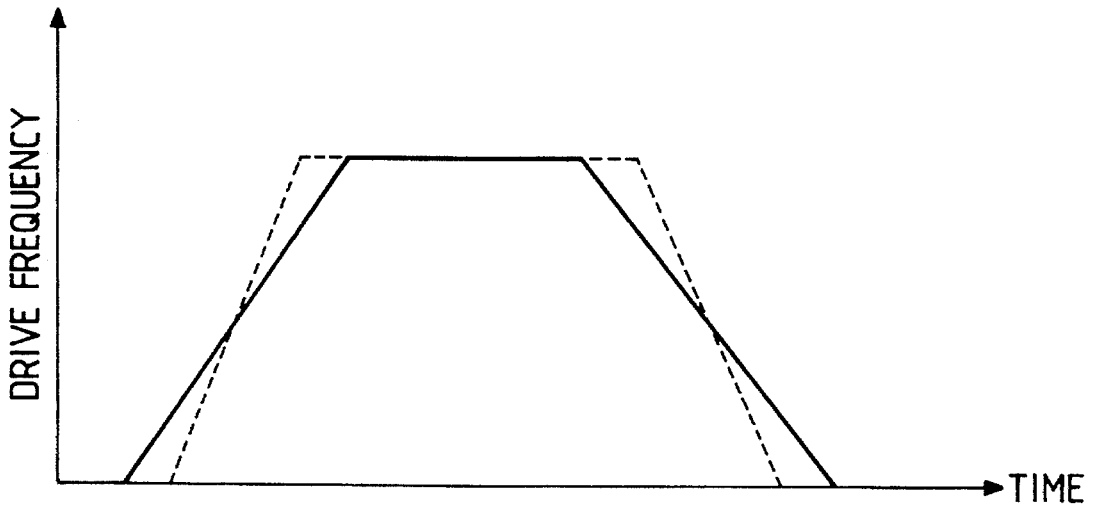
FIG. 26 is a timing chart showing the first motor drive profile in the fifth embodiment.

Therefore, in this case, the motor must be driven according to a more moderate profile than a standard profile indicated by a broken line in FIG. 26, as may be exemplified by a motor drive profile indicated by a solid line in the timing chart of the motor drive profile in FIG. 26.

When the state shown in FIG. 24 is switched to the state shown in FIG. 25, i.e., when the developer 8*b* is switched to the developer 8*a*, the central developer 8*b* can be driven by a relatively low torque since it moves in the same direction as the direction G of gravity when the rotation is started. On the other hand, when the rotation is stopped, since the motor must be braked in the direction against the direction G of gravity, a relatively high torque is required.

Figure 27:
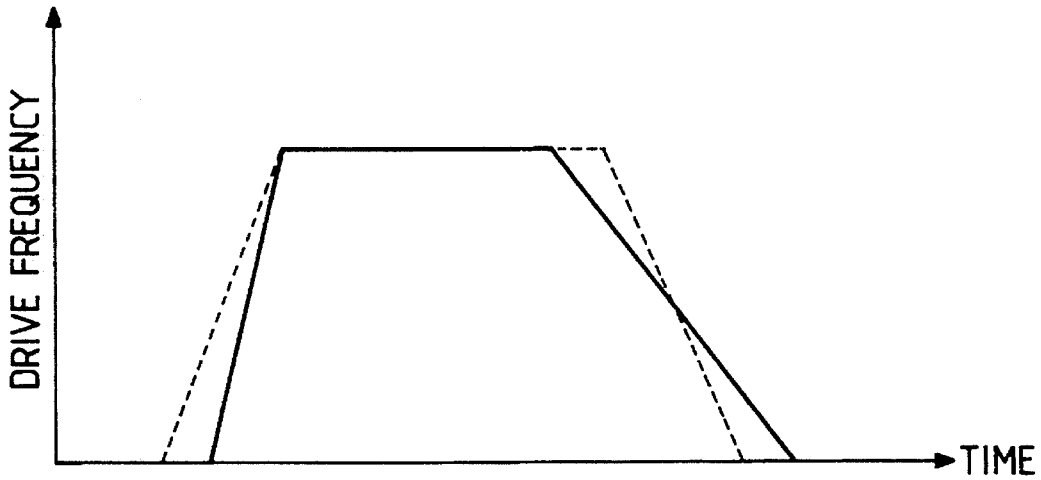
FIG. 27 is a timing chart showing the second motor drive profile in the fifth embodiment.

Therefore, in this case, the motor must be started up within a relatively short period of time, and must be slowed down according to a relatively moderate profile, as indicated by a solid line in the timing chart of the motor drive profile in FIG. 27.

When the state in FIG. 25 is switched to the state shown in FIG. 23, i.e., when the developer 8*a* is switched to the developer 8*c*, the central developer 8*b* can be driven by a relatively low torque since it moves in the direction G of gravity when the rotation is started. Also, when the rotation is stopped, a relatively low torque is required since the motor can be braked in the direction G of gravity.

Figure 28:
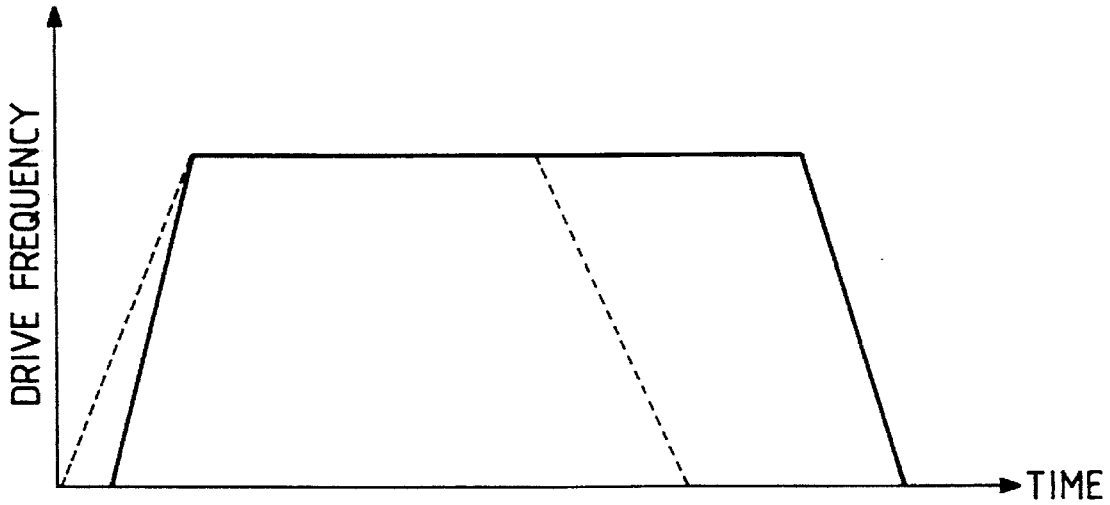
FIG. 28 is a timing chart showing the third motor drive profile in the fifth embodiment.

Therefore, in this case, the motor can be started up and slowed down within a relatively short period time, as indicated by a solid line in the timing chart of the motor drive profile in FIG. 28. In this case, since the moving distance of the developer 8*c* from the position in FIG. 25 to the position facing a photosensitive drum 9 is twice as large as that required upon switching of other developers, the switching time of the developer is inevitably prolonged, as shown in FIG. 28.

Figure 21:
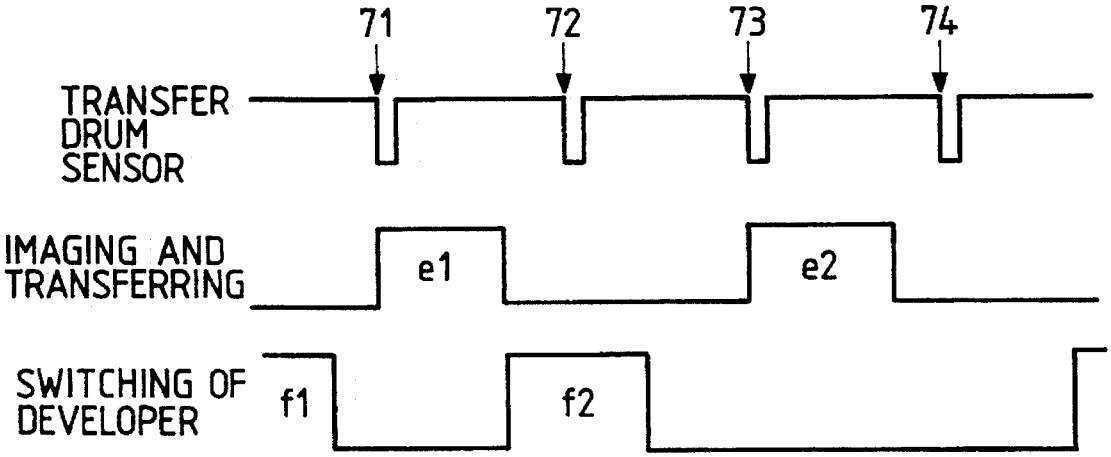
FIG. 21 is a timing chart showing the operation timing of a transfer drum and the switching timing of developers according to the fourth embodiment of the present invention.
Figure 22:
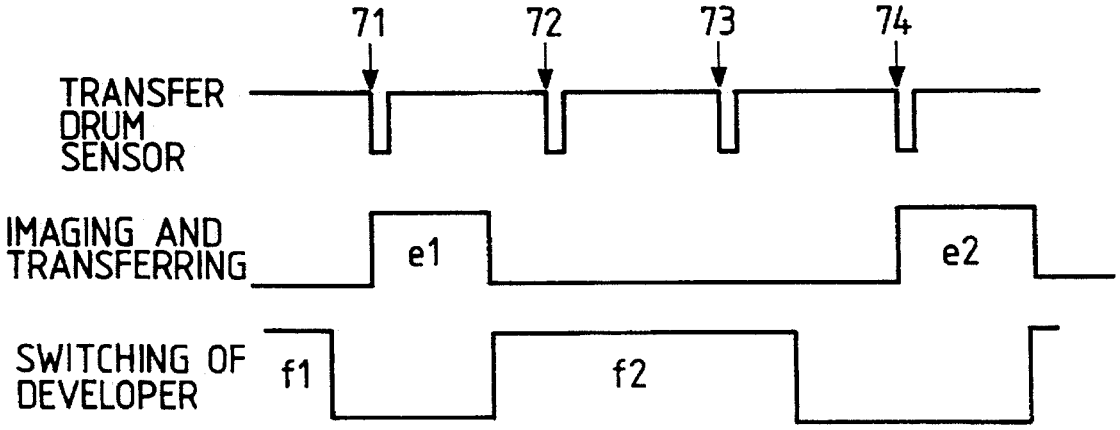
FIG. 22 is another timing chart showing the operation timing of a transfer drum and the switching timing of developers according to the fourth embodiment of the present invention.

For this reason, in the imaging order, the third color is preferably imaged in the state shown in 10 FIG. 25. Therefore, the first color is imaged in the state shown in FIG. 23, and the second color is then imaged in the state shown in FIG. 24. The drive profile shown in FIG. 26 is applied to the imaging operation of the second color, and in this case, the switching operation of the developers requires a relatively long period of time. For this reason, the switching operation probably cannot be completed to be in time for a second imaging timing 72 in FIG. 21. Therefore, in this case, the imaging timing 72 in FIG. 21 is passed without imaging, and an imaging timing 73 in FIG. 21 of the third color is determined to be the imaging timing of the second color in place of the second imaging timing 72 in FIG. 21. Furthermore, when the third color is imaged in the state shown in FIG. 25, an imaging timing 74 of the fourth color in FIG. 21 is preferably determined to be that of the third color.

Sixth Embodiment

Figure 29:
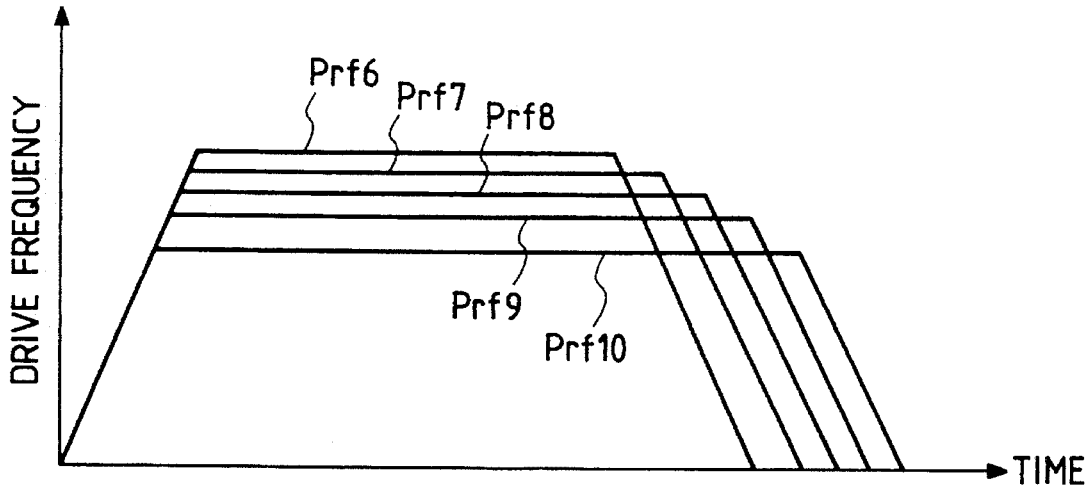
FIG. 29 is a timing chart showing motor drive profiles in the sixth embodiment of an image forming apparatus according to the present invention.

The sixth embodiment of an image forming apparatus according to the present invention will be described below with reference to the timing chart showing the motor drive profiles in FIG. 29.

This embodiment pays attention to the fact that a stepping motor can generate a higher torque as its drive speed is lower, and the motor is driven at a low speed when the load is large. As shown in FIG. 29, five steps of motor drive profiles prf6 to prf10 of the maximum drive speed, i.e., the maximum drive frequency are set, and these drive profiles are applied in correspondence with the load state of the developer selection unit 1. Note that the motor drive profiles prf6 to prf10 are set to have higher torques in the order named.

For example, these drive profiles prf6 to prf10 are applied in correspondence with the above-mentioned developer attachment states shown in FIGS. 16 to 20, as shown in Table 5 below. More specifically, since the load increases in the order of the numbers of figures in the developer attachment states shown in FIGS. 16 to 20, the drive profiles correspond to these states in the order of prf6 to prf10.

TABLE 5

| Developer Attachment State | FIG. 16 | FIG. 17 | FIG. 18 | FIG. 19 | FIG. 20 |
|---|---|---|---|---|---|
| Profile to be Selected | prf 6 | prf 7 | prf 8 | prf 9 | prf 10 |

Note that this embodiment and the fourth embodiment may be combined, so that as the load of the developer selection unit is larger, and a higher torque is required, the drive speed of the stepping motor may be lowered to moderate slowup and slowdown curves.

Alternatively, this embodiment and the fifth embodiment may be combined, so that the slowup gradient and/or slowdown gradient may be changed in accordance with the positional relationship of the developers upon rotation in the developer attachment state shown in FIG. 19.

Seventh Embodiment

Figure 30:
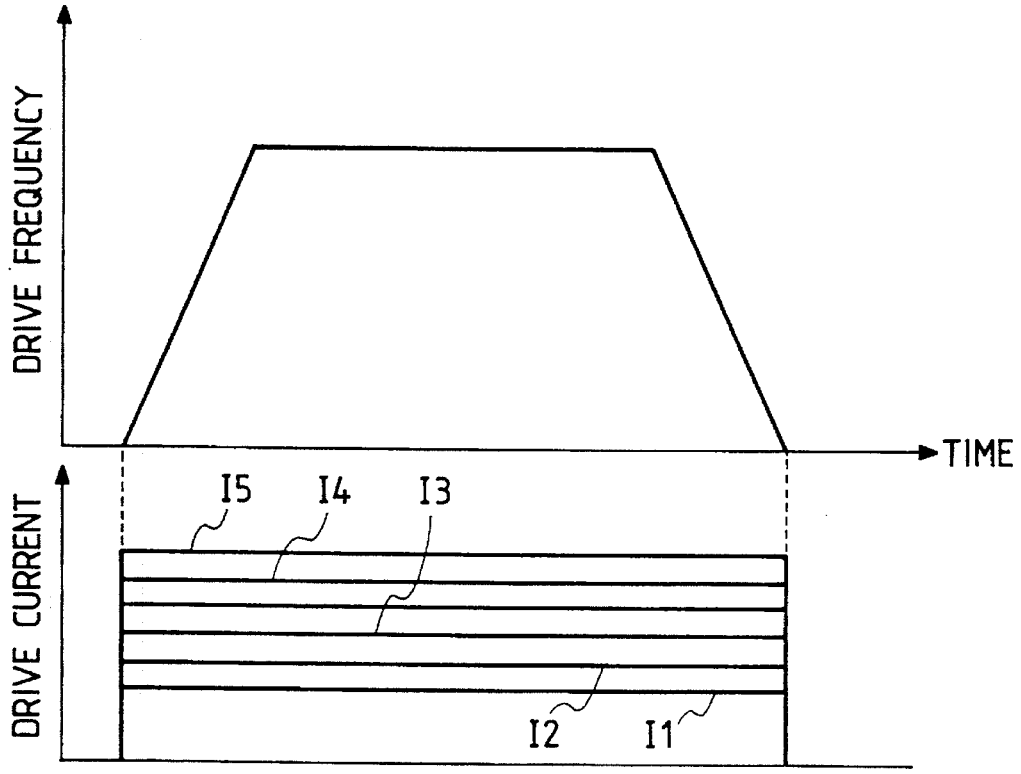
FIG. 30 is a timing chart showing motor drive profiles in the seventh embodiment of an image forming apparatus according to the present invention.

The seventh embodiment of an image forming apparatus according to the present invention will be described below with reference to the timing chart showing the motor drive profiles in FIG. 30.

This embodiment pays attention to the fact that a stepping motor can generate a higher torque as the drive current is larger within a predetermined range, and the motor is driven by a larger drive current as the load is larger. As shown in FIG. 30, five steps of drive currents I1 to I5 of the stepping motor are set, as shown in FIG. 30, and these drive currents I1 to I5 are applied in accordance with the load state of the developer selection unit 1. Note that the drive currents I1 to I5 become larger in the order named, i.e., the torque of the stepping motor increases in this order.

For example, the drive currents I1 to I5 are applied in accordance with the above-mentioned developer attachment states shown in FIGS. 16 to 20, as shown in Table 6 below. More specifically, since the load increases in the order of the numbers of figures in the developer attachment states shown in FIGS. 16 to 20, they correspond to the drive currents I1 to I5 in the order named.

TABLE 6

| Developer Attachment State | FIG. 16 | FIG. 17 | FIG. 18 | FIG. 19 | FIG. 20 |
|---|---|---|---|---|---|
| Profile to be Selected | I1 | I2 | I3 | I4 | I5 |

Note that this embodiment may be combined with the fourth and fifth embodiments, so that as the load of the developer selection unit becomes larger and a higher torque is required, the drive speed of the stepping motor may be lowered to moderate slowup and slowdown curves.

Eighth Embodiment

The eighth embodiment of an image forming apparatus according to the present invention will be described below with reference to FIGS. 31 and 32.

Figure 31:
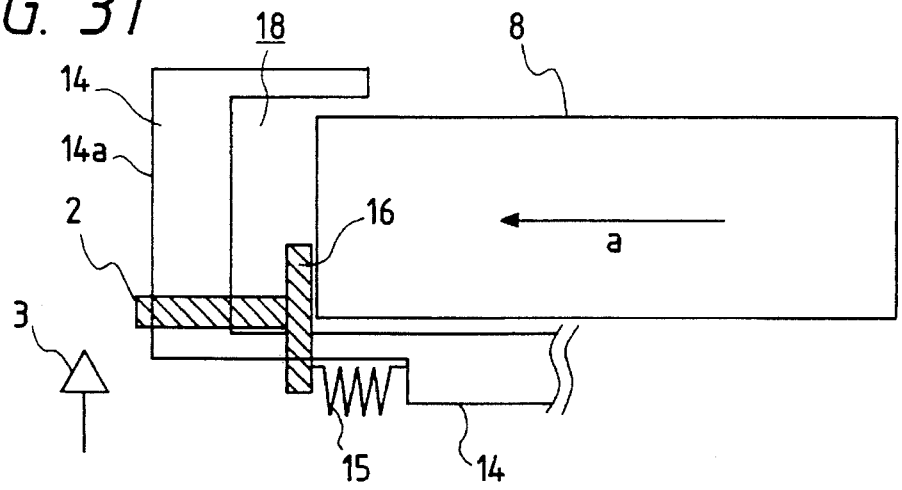
FIG. 31 is a schematic view showing a sensor flag mechanism according to the eighth embodiment of an image forming apparatus of the present invention.
Figure 32:
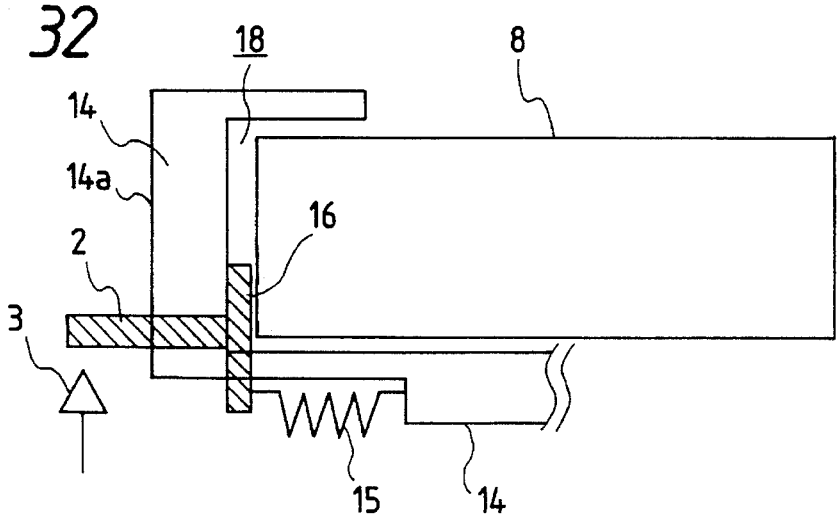
FIG. 32 is a schematic view showing a sensor flag detectable state of the sensor flag mechanism shown in FIG. 31.

Referring to FIG. 31, a developer holding member 14 for holding a developer 8 is arranged integrally with a developer selection unit (FIG. 19). The developer holding member 14 has a gap portion 18 for storing the end portion of the developer 8, and also has a developer abutting member 16 which is movable in the direction of an arrow a upon attachment movement of the developer 8. A sensor flag 2 is attached to the developer abutting member 16 to extend through a vertical wall portion 14*a* of the developer holding member 14, and the developer abutting member 16 is coupled to a proper portion of the developer holding member 14 via a spring 15. Furthermore, a sensor 3 is arranged near the distal end of the sensor flag 2.

In this arrangement, when the developer 8 is attached to the developer holding member 14 by movement in the direction of the arrow a, as shown in FIG. 31, the developer abutting member 16 is pushed by the end face of the developer 8 in the direction of the arrow a against the biasing force of the spring 15. Thus, the sensor flag 2 moves together with the developer abutting member 16, and its distal end portion is pushed outside the developer holding member 14, as shown in FIG. 32. As a result, the distance end portion of the sensor flag 2 can be detected by the sensor 3.

On the other hand, when the developer 8 is removed, the sensor flag 2 and the developer abutting member 16 are pulled out in the direction opposite to the arrow a by the spring 15, and are returned to the state shown in FIG. 31, i.e., to positions where the sensor flag 2 is not detected by the sensor 3.

When the above-mentioned sensor flag mechanism is arranged for each developer, the number and positional relationship of attached developers can be detected by a single sensor, and the rotational position of the developer selection unit can also be detected, thus providing a low-cost detection mechanism.

Ninth Embodiment

The ninth embodiment of an image forming apparatus according to the present invention will be described below with reference to the timing chart of the motor drive profiles in FIG. 33, the schematic view of the arrangement of a drive system of a developer selection unit in FIG. 34, and the pattern views of the rotation positional relationship of developers in FIGS. 35 and 36.

Figure 33:
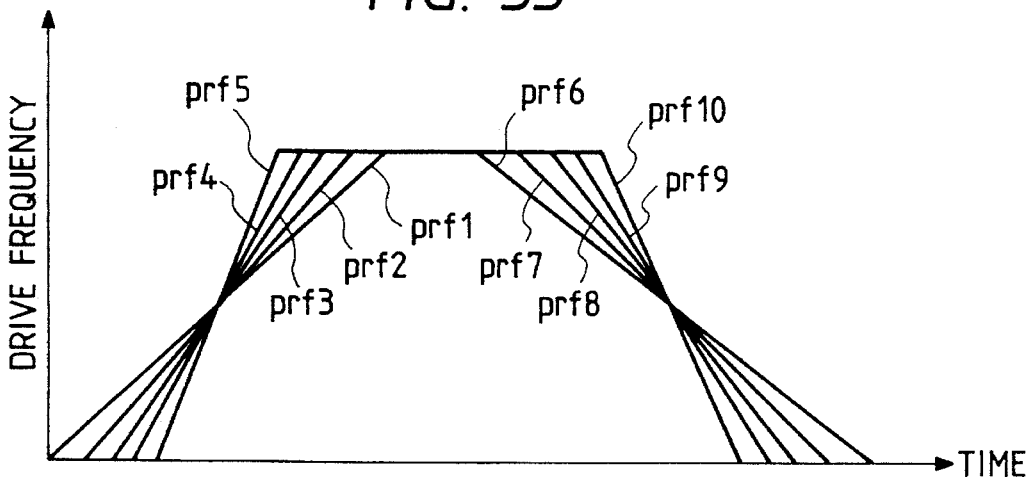
FIG. 33 is a timing chart showing the drive profiles of a stepping motor according to the ninth embodiment of an image forming apparatus of the present invention.

When a developer selection unit 1 is started, since a motor control circuit 7 does not recognize the weight balance of developers, a stepping motor 6 is started in accordance with a drive profile prf1 to be applied to a maximum load of those shown in FIG. 33.

Note that the drive profiles shown in FIG. 33 include slowup profiles prf1 to prf5 which are set to allow application from larger to smaller loads in the order named, and slowdown profiles prf6 to prf10 which are set to allow application from larger to smaller loads in the order named.

More specifically, these profiles prf1 to prf5 are set so that the slowup gradients increase in the order of prf1 to prf5, and the profiles prf6 to prf10 are set so that the slowdown gradients increase in the order of prf6 to prf10. The drive profile prf1 has a slowup curve of the smallest gradient, and the drive profile prf6 has a slowdown curve of the smallest gradient, as shown in FIG. 33.

Figure 34:
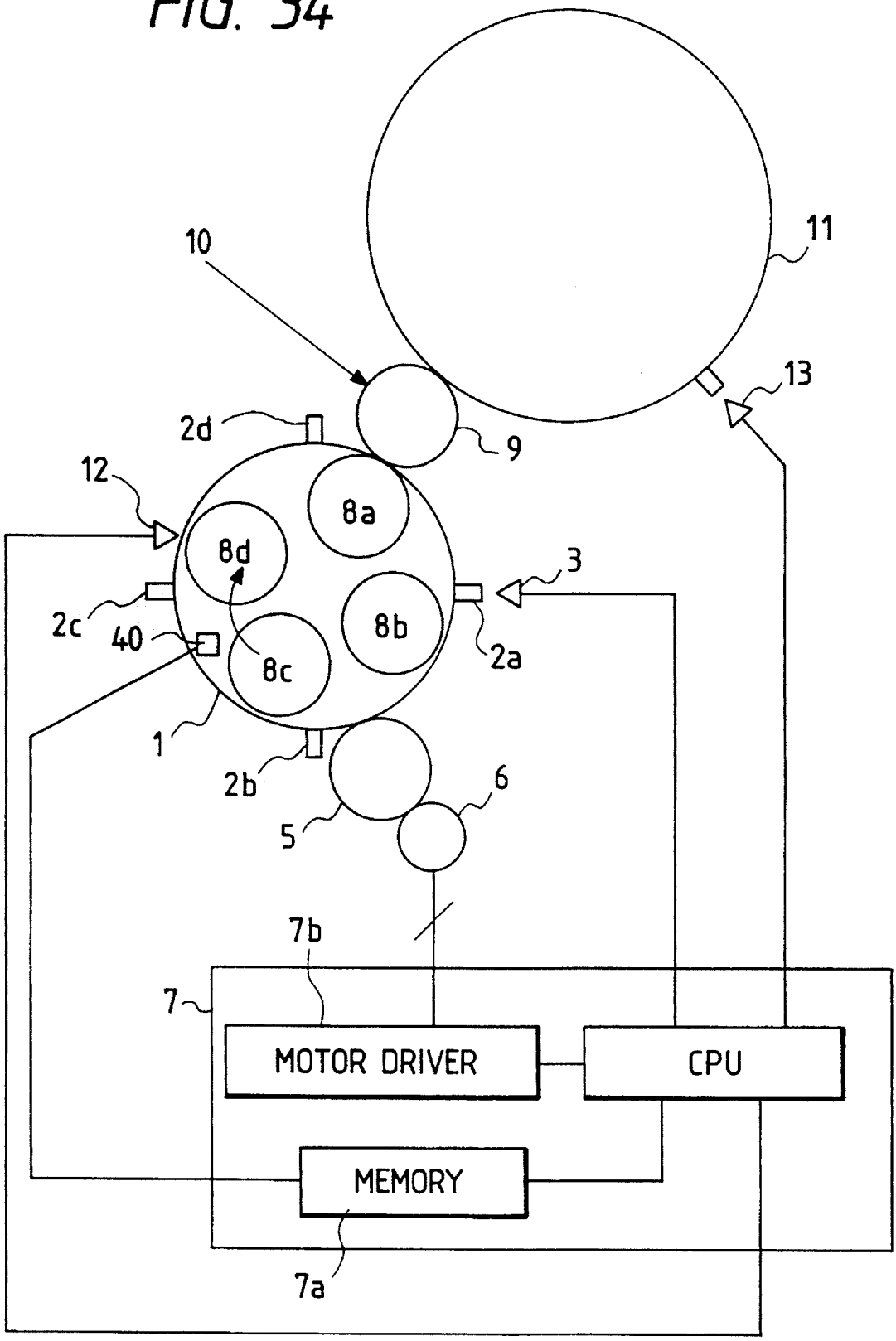
FIG. 34 is a schematic view showing the arrangement of a drive system of a developer selection unit in an image forming apparatus according to the present invention.

The developer selection unit 1 is rotated based on the drive profile prf1, and during this interval, the remaining toner amount in each developer is detected as a weight parameter of each developer by a toner amount detection means 40 fixed to the apparatus main body shown in FIG. 34. The detected amount is stored in a memory 7*a* in the motor control circuit 7. Note that a toner amount detection means described in, e.g., Japanese Patent Application No. 5-69228 is particularly suitable. However, the present invention is not limited to this as long as the remaining toner amount in each developer can be precisely detected.

Figure 36:
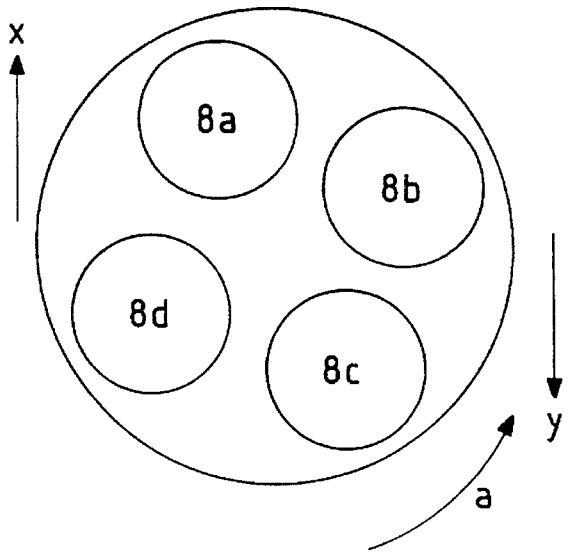
FIG. 36 is a second pattern view showing the rotation positional relationship among developers in the developer selection unit.

When the developer selection unit 1 is started from the state shown in FIG. 36, the most proper drive profile is selected from the above-mentioned drive profiles in accordance with the total weight of the four developers.

More specifically, as shown in FIG. 36, when the developer selection unit 1 is rotated in the direction of an arrow a in FIG. 36, developers 8*a* and 8*b* of four developers 8*a*, 8*b*, 8*c*, and 8*d* are rotated in the direction opposite to the direction of the gravity, and the developers 8*c* and 8*d* move in the direction of the gravity. If the weights of these developers are respectively represented by 8*aw*, 8*bw*, 8*cw*, and 8*dw*, we have:

$$8aw+8bw-(8cw+8dw)=S$$

As S, i.e., the difference between the total weight of the developers 8*a* and 8*b* which move in the direction opposite to the direction of the gravity, and the total weight of the developers 8*c* and 8*d* which move in the direction of the gravity becomes larger, the difference between a force x for moving the developers upward and a force y according to the gravy becomes larger, and the torque required for starting the developer selection unit becomes larger. If the total weight of the four developers is represented by:

$$8aw+8bw+8cw+8dw=M$$

as M, i.e., the total weight of the four developers becomes larger, the torque required for starting up the developer selection unit becomes larger. Therefore, if the torque required for starting up the developer selection unit is represented by Tu, the following functional relationship is established among Tu, S, and M:

$$Tu=F(S)+G(M)$$

Tu can assume a stepless value from a largest state to a smallest state depending on the consumption amounts of toners, and the like. The range of Tu is divided into five steps, and an optimal profile is selected from those shown in FIG. 33 in correspondence with the steps. If the largest state of Tu is represented by 5, and the smallest state is represented by 1 by decreasing the numeral in turn, the acceleration time must be prolonged as Tu becomes larger.

As for deceleration, as M, i.e., the total weight of the four developers becomes larger, a longer deceleration time is required. However, as for S, since the force in the deceleration direction increases in such a state, the deceleration time can be shortened. Therefore, when the positional relationship of the developers at the beginning of deceleration corresponds to a state shown in FIG. 35, if the torque required for stopping the developer selection unit is represented by Td, the following functional relationship is established among Td, S, and M:

$$Td=-F(S)+G(M)$$

If the largest state of Tu is represented by 5, and the smallest state is represented by 1, by decreasing the numeral in turn, the deceleration time must be prolonged as Td becomes larger.

Table 7 below summarizes the above description. More specifically, an optimal start profile is selected from the start profiles prf1 to prf5 in accordance with the calculated torque Tu required for starting the developer selection unit, and an optimal deceleration profile is selected from the deceleration profiles prf6 to prf10 in accordance with the calculated torque Td required for stopping the developer selection unit. Then, the stepping motor is driven in accordance with the selected profiles.

TABLE 7

| | 1 | 2 | 3 | 4 | 5 |
|---|---|---|---|---|---|
| | | Tu | | | |
| Start Profile to be Selected | prf5 | prf4 | prf3 | prf2 | prf1 |
| | | Td | | | |
| Deceleration Profile to be Selected | prf10 | prf9 | prf8 | prf7 | prf6 |

At this time, since the positional relationship among the four developers 8*a*, 8*b*, 8*c*, and 8*d* changes between the slowup and slowdown operations, S, i.e., the difference between the weight of the developers which move in the direction opposite to the gravity, the weight of the developers which move in the direction of the gravity is calculated at each position.

Upon rotation of the developer selection unit 1, if the sum of the weights of developers which move in the direction of gravity is represented by H, and the sum of the weights of developers which move in the direction opposite to the direction of gravity is represented by I, we have:

$$S=I-H$$

Figure 35:
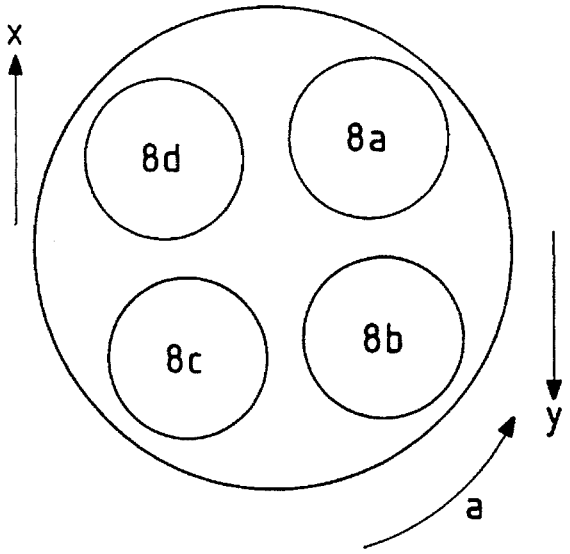
FIG. 35 is a first pattern view showing the rotation positional relationship among developers in the developer selection unit; 10

In FIGS. 35 and 36, for example, if index numbers indicating weight differences of the developers are respectively given by 8*a*=1, 8*b*=3, 8*c*=2, and 8*d*=4, then when the rotation is started, S=−2 in the state shown in FIG. 35 since I=8*a*+8*b*=4 and H=8*c*+8*d*=6, and the state shown in FIG. 35 corresponds to a pattern allowing quick start. When the developer selection unit is further rotated from the state shown in FIG. 35, and the developer 8*a* with the weight difference index number=1 is directed in the direction of the gravity, as shown in FIG. 36, S=0 since I=8*b*+8*c*=5 and H=8*a*+8*d*=5, and the state shown in FIG. 36 corresponds to a balanced state. A slowdown curve is selected assuming in advance that the developer selection unit 1 is set in this state upon selection of this slowdown curve.

As can be seen from the above description, optimal start and deceleration profiles for starting and stopping the developer selection unit are selected in correspondence with the remaining toner amounts and the rotation positional relationship of the developers, and the stepping motor is driven in accordance with the selected profiles. Thus, the developer selection unit can be stably driven against a large load variation by a low-cost arrangement.

Tenth Embodiment

The 10th embodiment of an image forming apparatus according to the present invention will be described below with reference to the timing chart showing the drive profiles in FIG. 37.

Figure 37:
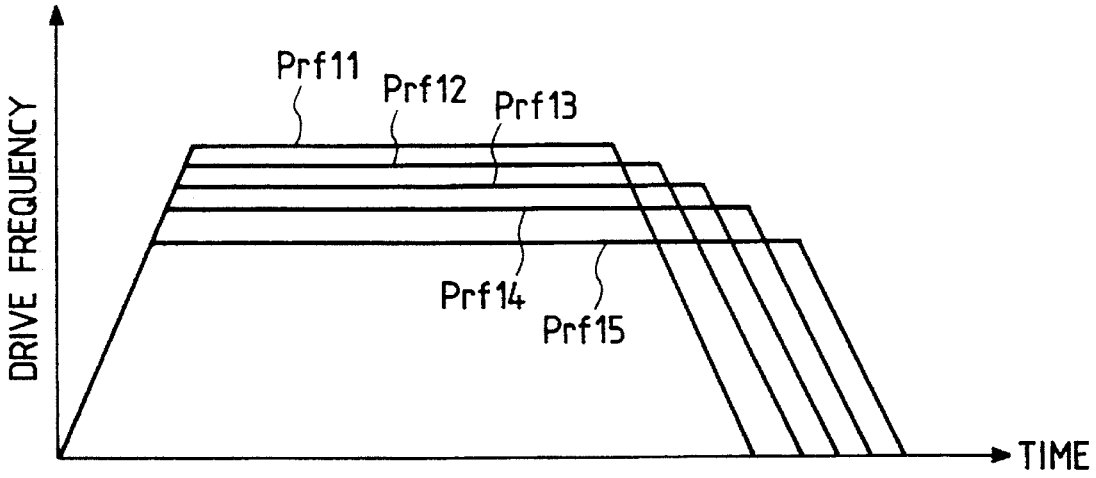
FIG. 37 is a timing chart showing the drive profiles of a stepping motor according to the 10th embodiment of an image forming apparatus of the present invention.

This embodiment pays attention to the fact that a stepping motor can obtain a higher torque as the drive speed is lower within a predetermined drive frequency range, and sets five steps of drive profiles prf11 to prf15 of the drive speed, i.e., the maximum drive frequency, as shown in FIG. 37. An optimal drive profile is selected in accordance with a torque Tu required for starting the developer selection unit, as shown in Table 8 below, and the stepping motor is driven on the basis of the selected drive profile. Note that in these drive profiles, the upper limit of the drive frequency becomes higher as Tu becomes smaller.

TABLE 8

| Tu | 1 | 2 | 3 | 4 | 5 |
|---|---|---|---|---|---|
| Profile to be Selected | prf11 | prf12 | prf13 | prf14 | prf15 |

As for the slowdown operation, as a torque Td required for stopping the developer selection unit becomes larger, a slowdown curve with a smaller gradient is selected. At this time, if the speed in a constant speed drive operation is different even when the slowdown curve remains the same, the moving amount until the developer selection unit stops changes. For this reason, when a constant speed is selected, a slowdown curve is selected in accordance with Td, and a slowdown timing is determined in accordance with the moving amount.

Eleventh Embodiment

Figure 38:
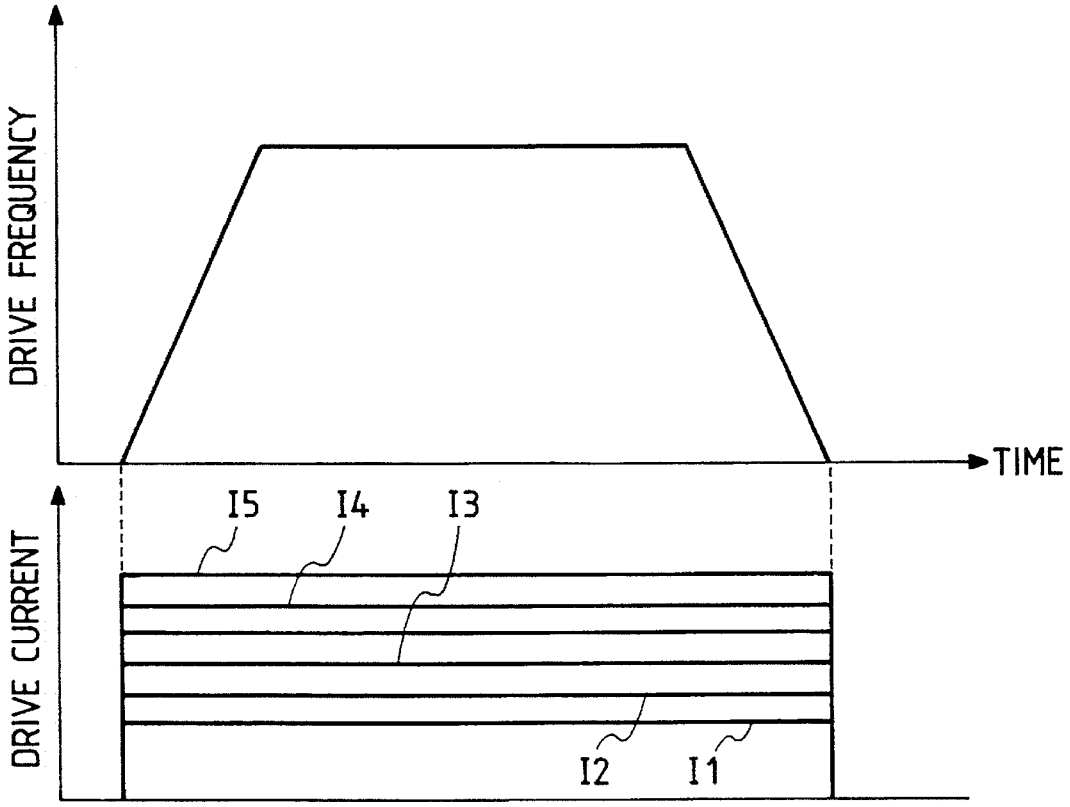
FIG. 38 is a timing chart showing the drive profiles of a stepping motor according to the 11th embodiment of an image forming apparatus of the present invention.

The 11th embodiment of an image forming apparatus according to the present invention will be described below with reference to the timing chart in FIG. 38, which shows a drive current graph and drive profiles at the same time.

This embodiment pays attention to the fact that a stepping motor can generate a higher torque as the drive current is larger within a predetermined range, and the motor can be driven by a larger drive current as the load is larger. As shown in FIG. 38, five steps of drive currents of the stepping motor are set, and these drive currents I1 to I5 are applied in accordance with the load state of the developer selection unit, as shown in Table 9 below. When the weight balance changes during rotation, as shown in FIG. 36, the drive current value may be changed at that time.

TABLE 9

| Tu/Td | 1 | 2 | 3 | 4 | 5 |
|---|---|---|---|---|---|
| Profile to be Selected | I1 | I2 | I3 | I4 | I5 |

This embodiment may be combined with the ninth and 10th embodiments, so that as a higher torque is required, the drive current may be increased, the drive speed may be lowered, and the gradients of the slowup and slowdown curves may be decreased.

The preferred embodiments of the present invention have been described. However, the present invention is not limited to these embodiments, and various changes and modifications may be made within the spirit and scope of the invention.

What is claimed is:

1. An image forming apparatus comprising:

an image carrier for carrying an electrostatic image;

a developer unit having a plurality of developers each for developing the electrostatic image on said image carrier;

drive means for driving said developer unit to stop a selected developer at a predetermined position facing said image carrier;

detection means for detecting a stop position of the developer; and adjustment means for adjusting drive control of said developer unit by said drive means in accordance with a detection output from said detection means.

2. An apparatus according to claim 1, wherein said adjustment means adjusts the drive control on the basis of a position deviation amount between the stop position and the predetermined position.

3. An apparatus according to claim 1, wherein said drive means has a motor, and said adjustment means adjusts a drive current of the motor.

4. An apparatus according to claim 1, wherein said plurality of developers respectively store different color toners.

5. An apparatus according to claim 1, wherein said developer unit is rotatable about a rotational shaft.

6. An image forming apparatus comprising:

an image carrier for carrying an electrostatic image;

a developer unit having a plurality of detachable developers;

drive means for driving said developer unit to stop a selected developer at a developing position facing said image carrier;

detection means for detecting a presence/absence of the developers of said developer unit; and adjustment means for adjusting drive control of said developer unit by said drive means in accordance with a detection output from said detection means.

7. An apparatus according to claim 6, wherein said detection means detects the presence/absence of each of said plurality of developers.

8. An apparatus according to claim 6, wherein said detection means detects an attachment position of the developer, and said adjustment means adjusts the drive control on the basis of both presence/absence information and attachment position information of the developer.

9. An apparatus according to claim 6, wherein said drive means has a motor, and said adjustment means adjusts a drive current of the motor.

10. An apparatus according to claim 6, wherein said plurality of developers respectively store different color toners.

11. An apparatus according to claim 6, wherein said developer unit is rotatable about a rotational shaft.

12. An image forming apparatus comprising:

an image carrier for carrying an electrostatic image;

a developer unit having a plurality of developers each for developing the electrostatic image on said image carrier;

drive means for driving said developer unit to stop a selected developer at a developing position facing said image carrier;

detection means for detecting information associated with a weight of the developer; and adjustment means for adjusting drive control of said developer unit by said drive means in accordance with a detection output from said detection means.

13. An apparatus according to claim 12, wherein said developer stores a toner, and said detection means detects a remaining amount of the toner.

14. An apparatus according to claim 12, wherein said drive means has a motor, and said adjustment means adjusts a drive current of the motor.

15. An apparatus according to claim 12, wherein said plurality of developers respectively store different color toners.

16. An apparatus according to claim 12, wherein said developer unit is rotatable about a rotational shaft.

* * * * *

UNITED STATES PATENT AND TRADEMARK OFFICE

CERTIFICATE OF CORRECTION

PATENT NO. : 5,471,292

DATED : November 28, 1995

INVENTOR(S) : KAZUHIKO OKAZAWA

It is certified that error appears in the above-indentified patent and that said Letters Patent is hereby corrected as shown below:

Column 4

Line 40, "unit; 10 FIG. 36" should read --unit; FIG. 36--.

Column 10

Line 42, "in 10 FIG. 25." should read --in FIG. 25.--.

Column 12

Line 33, "distance" should read --distal--.

Column 13

Line 39, "gravy" should read --gravity--.

Signed and Sealed this

Twenty-sixth Day of March, 1996

Bruce Lehman

*Attest:*

BRUCE LEHMAN

*Attesting Officer*

*Commissioner of Patents and Trademarks*